US011937674B1

(12) United States Patent
Tiscione

(10) Patent No.: US 11,937,674 B1
(45) Date of Patent: Mar. 26, 2024

(54) CARD HOLDER AND EJECTOR

(71) Applicant: ACM ENTERPRISES, INC., Tucson, AZ (US)

(72) Inventor: James A. Tiscione, Tucson, AZ (US)

(73) Assignee: ACM ENTERPRISES, INC., Tucson, AZ (US)

( * ) Notice: Subject to any disclaimer, the term of this patent is extended or adjusted under 35 U.S.C. 154(b) by 0 days.

(21) Appl. No.: 18/374,931

(22) Filed: Sep. 29, 2023

Related U.S. Application Data

(60) Provisional application No. 63/458,298, filed on Apr. 10, 2023.

(51) Int. Cl.
*A45C 11/18* (2006.01)

(52) U.S. Cl.
CPC ..... *A45C 11/182* (2013.01)

(58) Field of Classification Search
CPC ..... A45C 11/182
USPC ..... 150/147
See application file for complete search history.

(56) References Cited

U.S. PATENT DOCUMENTS 1,658,496 A * 2/1928 Qvarnstrom ..... A45C 11/18 220/345.2
4,697,698 A * 10/1987 Holdener ..... A45C 11/182 206/37
4,792,058 A * 12/1988 Parker ..... B65D 83/12 221/232
6,412,627 B1 * 7/2002 Tiscione ..... A45F 5/00 150/147
7,267,147 B2 * 9/2007 Tiscione ..... A45C 11/182 150/147
D667,829 S * 9/2012 Berntsen ..... D14/435
10,413,378 B2 * 9/2019 Khajavi ..... A61B 50/3001

OTHER PUBLICATIONS

Wallet Surfer: ACM Wallet Review https://www.youtube.com/watch?v=Xw8aNaQlsVQ&t=8s (Year: 2021).*

* cited by examiner

*Primary Examiner* — Don M Anderson
*Assistant Examiner* — Justin Caudill
(74) *Attorney, Agent, or Firm* — Quarles & Brady LLP; Yakov S. Sidorin

(57) ABSTRACT

A card holder that includes a body defining an inner cavity with a front opening and at least one back opening. The inner cavity is limited by an upper plate, a lower plate, and two side walls. The upper plate bifurcates towards the back opening into first and second subplates that are separated from one another along the two side walls by a gap shaped as a pocket which houses ends of the multiple slidable card actuators of the holder. Long arms of the actuators are rested on the upper surface of the second subplate, while short arms are disposed below the second subplate. The body is preferably monolithic, and in one case at least one support element may be permanently affixed to the second subplate and/or the lower plate. When such support element(s) is affixed to both, the misalignment of the elements of the body and/or breakage thereof is substantially eliminated.

21 Claims, 21 Drawing Sheets

TOPSIDE,
NO ACTUATORS INSTALLED

SIDE

UNDERSIDE
ASSEMBLED

ACTUATOR
WITH SPRING

ACTUATOR

1-6 ACTUATORS
WITH SPRINGS

1-6 ACTUATORS

FRONT VIEW
Main Body + Actuators

FIG. 16

INDEX

1.) Main Chassis / Body
2.) (Silicone) Clutch Pad(s)
3.) Clutch Pad Housing
4.) Actuators
5.) Actuator Platform
6.) Actuator Spring Housing Guides
7.) Springs
8.) Spring Posts
9.) Sharktooth Grips
10.) a.) Support Stop
b.) Platform Braces
c.) Alignment Teeth
11.) Card Tracks
12.) Steel Money Clip
13.) Money Clip Mounts
14.) Side Grips
15.) Back Cover
16.) Back Cover Screws

CARD HOLDER AND EJECTOR

CROSS-REFERENCE TO RELATED APPLICATIONS

This US Patent Applications claims priority from and benefit of the U.S. Provisional Patent Application No. 63/458,298 filed on Apr. 10, 2023, the disclosure of which is incorporated by reference herein.

TECHNICAL FIELD

This invention is related in general to pocket or purse organizers and, in particular, to a device that is structured to organize, store, and protect wallet-sized cards, such as those containing credit or identification information.

RELATED ART

Inside a typical wallet or purse, one is likely to find a half-dozen or more cards such as license, credit, check, ATM, and membership cards, amongst others. The usual dimensions of these cards are approximately 8.5 cm in length by 5.5 cm in width and 1 mm or less in thickness. The storing, organizing, and retrieving of wallet-size cards has led to a need for compact, yet efficient, holders. (The holder is defined, generally, as a device or implement for holding something.) Standard wallets or purses may contain pockets or inserts of clear plastic envelopes that serve to store or organize cards. However, such features are not ideal for several reasons. First, cards can be difficult to retrieve from, or place into, deep pockets or plastic envelopes. Second, the space available for individual cards frequently is filled to capacity, requiring the storage of a stack of multiple cards in a single pocket or envelope. Thus, retrieval of a particular card is hampered because all cards in a stack must be at least partially removed or displaced during sorting. Moreover, cards can fall out of a purse or wallet pocket, or be fumbled and dropped while one is sorting through a stack to find a particular card.

Related art attempted to address this need (and proposed solutions) can be understood from various publications, including, for example, U.S. Pat. Nos. 4,697,698; 6,412,627, and 7,267,147 (the disclosure of each of which is incorporated herein by reference)—to name just few.

The operation of the card holders of related art remains, however, deficient in that such card holders are subject to unpredictable breakage and/or jamming occurring typically during the repositioning of the actuators. In reference to the design discussed in, for example, U.S. Pat. No. 7,267,147 (see, for example, FIG. 8) the U-shaped member portion 94 of the card ejection actuator is suspended below the top portion (ceiling) of the card holder from the button 96 that is placed above and onto the top piece 4 and secured to the button via a thin connector—such as a screw—that passes through the top piece 4. Such a multi-element ejection actuator structure has been proved to be prone to misalignment between the button and the U-shaped member or even to a breakage of the thin connector affixing the button to the U-shaped member under the pressure applied to the button by the user's finger. In operation, the spring 100 embedded in the U-shaped member 92 of the actuator would dislodge, leading to malfunction, thereby impeding the card ejection operation. Furthermore, under some circumstances such misalignment may lead to an additional misplacement of the U-shaped member underneath the top piece 4 in a direction transverse to the surface of the top piece towards the corresponding card housed in the cavity of the card holder, thus allowing a portion of the card actuator contact and/or press the corresponding card As a result of such contact/pressure, the card may become somewhat bent (out of its natural shape), which in turn leads to card misalignment within the holder and/or with respect to the card tracks of the holder and to the card becoming stuck.

Thus, there continues to be a need in the art for a card holder that stores, organizes, protects, and allows easy retrieval of a large number of individual cards in a compactly-designed and sturdy case, then has heretofore been known.

Implementation of the idea of the present invention solves both the often occurring problem of the breakage of the card actuator portion of the design of the related and the potential shortcoming of card bending within the card holder by (again, in reference to the structure discussed in U.S. Pat. No. 7,267,147) by removing or getting rid of not only the suspension-based cooperation (attachment) between (of) the body of the card holder and the element of the card-ejection assembly but also the use of a spatially separate from the card actuating member 92 button 96. Instead, the proposed embodiments are structured to carry out/effect such cooperation or attachment by simply supporting (not from above, but from below and/or from the sides, generally speaking) only a portion of the card actuator element with a substantially unmovable platform located, in one specific example, below such portion while, at the same time, allowing the other portion of the same card actuator reversibly move within the a separate upper space or slot-like pocket (of the card holder) that is limited from above and at least partially enclosed by such substantially unmovable platform. Stated differently, the persisting operational problem of related art is solved by physically separating a main volume of the card holder in which the cards are housed (that is, the internal cavity of the card holder) from the upper space in which an elongated arm of the card actuator moves. Such physical separation is carried out with the use of a rigid, substantially non-pliable layer or divider of the body of the card holder that is configured to be non-movable with respect to the rest of the body of the card holder, thereby preventing a card actuator from breaking and/or dislodging with respect to the body of the card holder.

SUMMARY

Embodiments of the invention provide a holder for a card. Such holder includes a body, at least one actuator, and a back plate. The body is formed by a top portion with an upper outer surface, a bottom portion with a lower outer surface, two side walls connecting the top portion with the bottom portion (each of the two side walls having a height), and an actuator platform that is supported by and extends substantially parallel to the lower outer surface between the two side walls and that is separated from the bottom portion by a first distance that is shorter than the height. (Here, a lower surface of the actuator platform, an upper internal surface of the bottom portion, and inner surfaces of the two side walls define an interior cavity with a front opening at a front end of the body and at least one back opening at a back end of the body). The at least one actuator is configured to slidably and reversibly move toward the front opening of the body above an upper surface of the actuator platform, and includes a J-shaped member having a first end configured to engage at least one card when at least one card is housed within the interior cavity and to reposition this card in a direction towards the front opening. The back cover is dimensioned to be removably cooperated with the body by sliding a top of the back cover between the two side walls to close the at least one back opening at the back end of the body from view. In at least one implementation, the holder is structured to satisfy at least one of the following conditions: (a) the at least one actuator includes a plurality of actuators and the holder is configured as a holder for the plurality of cards each of which is dimensioned as a wallet-sized card; (b) the two side walls connect the upper outer surface with the lower outer surface spatially uninterruptingly; (c) the body is a monolithic body; (d) the body includes a slot formed in at least one of the two side walls in a direction substantially transverse to the top portion and/or the bottom portion, while the holder additionally includes a corresponding resilient clutch pad dimensioned to be removably inserted into and through such slot transversely to the at least one of the two side walls to frictionally engage the plurality of cards within the internal cavity. Alternatively or in addition, and substantially in every embodiment, the holder may be configured such as to satisfy any and/or every of the following conditions: (i) the inner surfaces of the two side walls contain corresponding parallel grooves extending in the direction towards the front opening along the two side walls and spatially aligned with the at least one actuator of the plurality of actuators; (ii) the first end of the J-shaped member of the at least one actuator is configured to engage the at least one card when the at least one card is housed in the parallel grooves; (iii) a side of the J-shaped member that connects the first end of the J-shaped member with a second end thereof has a surface relief; (iv) the J-shaped member carries an indicium representing contents of the corresponding parallel slots; and/the holder may be configured such as to have an upper surface of the actuator platform extend under the upper outer surface of the top portion to form a slot-like pocket between the actuator platform and the upper outer surface. (In a specific case of the latter, the slot-like pocket may be dimensioned to receive therein a second end of the J-shaped member.) Additionally or in the alternative, and substantially in every implementation of the holder, the upper surface of the actuator platform may be structured to contain at least one groove that extends along the direction and that is shorter than an extent of the actuator platform along the direction, and/or such as to contain a plurality of substantially parallel grooves each of which is shorter than such extent. Optionally, the upper surface of the actuator platform may contain at least one platform groove extending along the direction, while the at least one actuator includes a corresponding actuator groove that faces the at least one platform groove when the corresponding actuator is assembled with the body. (When this is the case, the holder may be optionally configured to include at least one compression spring dimensioned to be housed in an elongated space formed between the at least platform groove and the corresponding actuator groove when the corresponding actuator is assembled with the body, and/or to have the at least one actuator include a protrusion extending from a base of the J-shaped member towards a second end of the J-shaped member, with such protrusion optionally shaped as a substantially cylindrical element extending substantially parallel to the actuator groove.)

Embodiments additionally provide a process or method the steps of which involve the use of substantially any of the embodiments of the holder. Such method (the subject of which is an embodiment of the holder that contains at least one card placed in the interior cavity with an edge of the at least one card against the first end of the J-shaped member of the at least one actuator), includes a step of moving a portion of the J-shaped member located above the actuator platform from a rest location in the direction towards the front opening to reposition a second end of the J-shaped member within a slot-like pocket formed between the actuator platform and the upper outer surface. Optionally, the method may include a step of repositioning—while so moving the above-identified portion of the J-shaped member—the card below the actuator platform towards the front opening by pushing the edge with the first end of the J-shaped member. The steps of moving may include compressing a spring positioned in contact with the J-shaped member, while the method additionally includes a step of returning the portion of the J-shaped member to the rest location by releasing the spring after a portion of the at least one card emerges through the front opening as a result of the repositioning, Substantially in every implementation of the method: (1) the step of returning may include maintaining the second end of the J-shaped member within the slot-like pocket and/or disengaging the first end from the edge surface of the at least one card, and/or (2) the step of moving may include sliding a protrusion of the J-shaped member, which extends under said portion of the J-shaped member, along and/or in a groove in the actuator platform, and/or (3) the step of pushing may include displacing the first end of the J-shaped member between a side wall of the two side walls and a support stop connecting the actuator platform with the bottom portion of the body, and/or (4) the step of repositioning the at least one card may include removing the edge of the at least one card from a groove formed in a support stop that connects the actuator platform with the bottom portion of the body. Alternatively or in addition, the embodiment of the method may include a step of placing the at least one card into the holder by sliding the at least one card into the interior cavity through the front opening and within a first groove formed in a side wall until the edge of the at least one card is rested in a second groove formed in a portion of the holder at the back end of the body, the first and second grooves laying in the same plane but being substantially transverse to one another; and/or the step of placing the at least one card into the holder by sliding the at least one card into the interior cavity through the front opening and between first and second resilient pads that protrude into the interior cavity through first and second slots formed, respectively, in the first and second side walls.

Embodiments of the invention additionally provide a method including a process for operating a card holder (that has a body defining an inner cavity therein and having a front opening at a front end of the holder, where the inner cavity is limited by an upper plate, a lower plate, and two side walls, and where the upper plate is structured to bifurcate away from the front opening into a first subplate and a second subplate forming a gap therebetween) by at least slidably reversibly moving at least one actuator (that includes a J-shaped member having a long arm positioned above the second subplate and a short arm positioned below the second subplate) towards the front opening such as to reposition an end of the long arm within the gap. Generally, the first subplate is farther away from the lower plate than the second subplate. Substantially every implementation of such method may include a step of repositioning—while so reversibly moving—a card contained in the inner cavity in a direction of the front opening while, at the same time, engaging this card by an end of the short arm of the J-shaped member below the second subplate; and/or a step of returning the J-shaped member to a rest position by releasing a spring that has been compressed during the step of slidably reversibly moving after the step of slidably reversibly moving has been completed. (Optionally, the step of returning may include maintaining the end of the long arm of the J-shaped member within the gap while disengaging the end of the short arm of said J-shaped member from a card contained in the inner cavity.) Alternatively or in addition, the process of operating the holder may be structured to include removing an edge of a card, disposed within the inner cavity, from a groove formed in a support stop connecting the second subplate with the lower plate.

Embodiments of the invention additionally provide a holder for a plurality of cards. The holder includes a body (that defines an inner cavity and has a front opening at a front end of the holder and at least one back opening at a back end of the holder, where the inner cavity is limited by an upper plate, a lower plate, and two side walls). The upper plate bifurcates towards the at least one back opening into a first subplate and a second subplate extending towards the back opening farther than the first subplate, while the first and second subplates separated from one another along the two side walls by a gap. In at least one implementation, the holder may be structured to include a plurality of actuators (at least one of which has a J-shaped member having a long arm and a short arm). At least one of these actuators is configured to slidably and reversibly move towards the front opening with the long arm of the actuator positioned to be above an upper surface of the second subplate and to be supported by the second subplate, and with the short arm of the actuator placed to be slidably and reversibly repositioned in a direction towards the front opening in the inner cavity below the second subplate—while engaging at least one card when said at least one card is housed within the interior cavity. Additionally or in the alternative, and substantially in every implementation, the holder may be configured to include a back cover dimensioned to be removably cooperated with the body by sliding a top of the back cover between the two side walls to close the at least one back opening from view.

BRIEF DESCRIPTION OF THE DRAWINGS

The invention will be more fully understood by referring to the following Detailed Description of Specific Embodiments in conjunction with the Drawings, of which:

FIGS. 10A, 10B, 10C, and 10D provide illustrations to various elements and components of an ejection tab assembly forming a part of the overall embodiment of the invention.

FIGS. 14, 15, and 16 illustrate additional details of and information pertaining to an embodiment of the invention.

Figure 1:
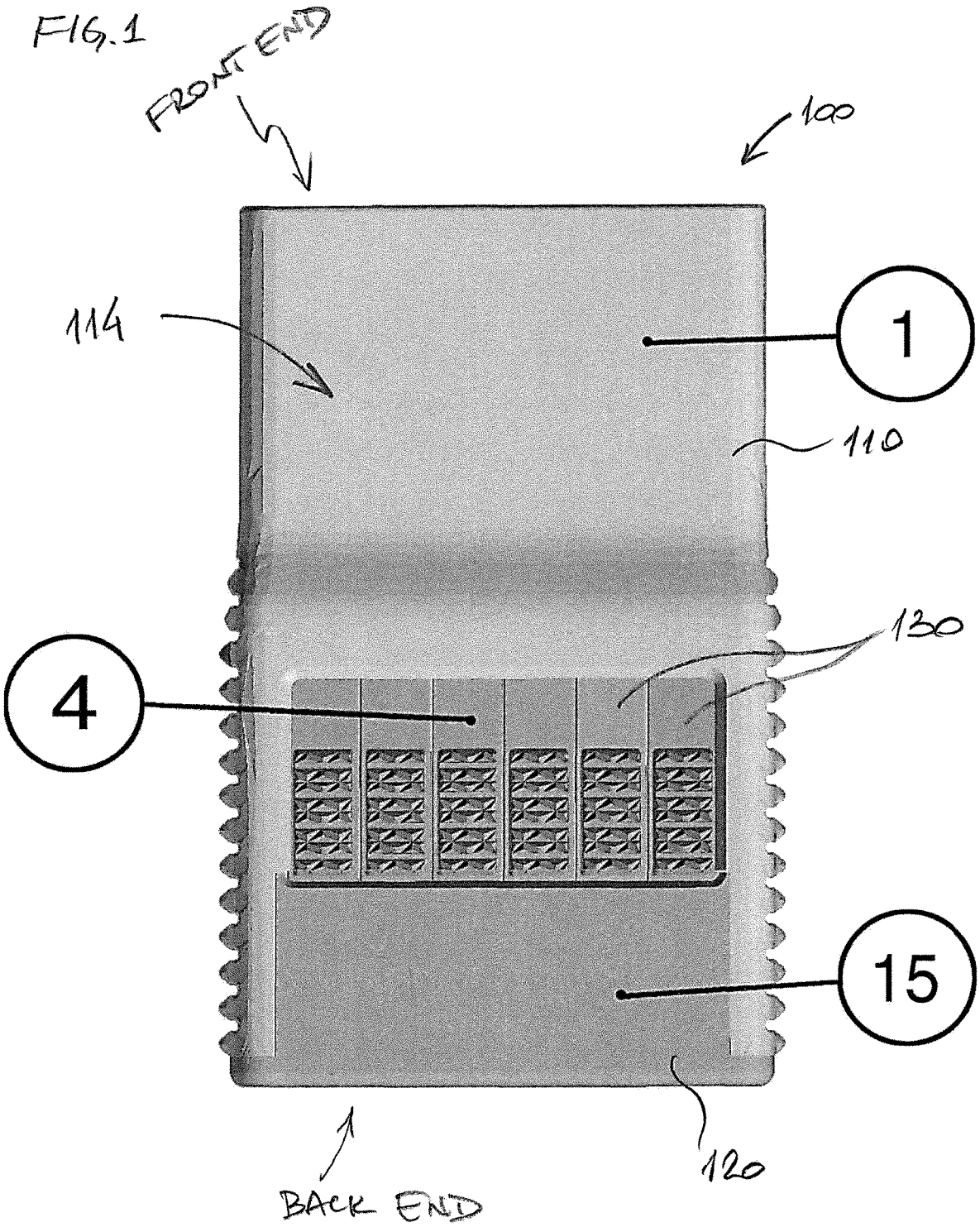
FIG. 1 illustrates an embodiment of the card holder, configured according to the idea of the invention, in top view.

Generally, the sizes and relative scales of elements in Drawings may be set to be different from actual ones to appropriately facilitate simplicity, clarity, and understanding of the Drawings. For the same reason, not all elements present in one Drawing may necessarily be shown in another. Drawings are generally not to scale.

DETAILED DESCRIPTION

Embodiments of the invention provide a three-dimensional case that contains a main interior cavity (volume) defined by a top portion of the case and a bottom portion of the case that are interconnected by two permanent side walls, and a removable/replaceable rear wall (or back wall, or back cover), with a front opening present at a front end of the case (even when the back wall is installed). In practice, at least one card is inserted through the front opening into one of several parallel slots disposed in each side wall of the case until such card is frictionally engaged, preferably by resilient pads (that are inserted/placed into the slots in each side wall to protrude from the side walls into the main interior cavity), and flush with an ejection tab assembly (interchangeably referred to herein as an actuator). The ejection tab assembly (the actuator) is located at the end of the main interior cavity that faces the back wall. An embodiment may include multiple actuators. Each actuator present in a given embodiment features an end that is adapted to be in alignment with and to engage a corresponding card. (Optionally, this design allows one or multiple cards to be displaced by a particular ejection tab assembly.)

In advantageous contradistinction to designs of related art, none of the ejection tab assemblies or actuators is fully suspended within the main internal cavity from a point located above the main internal cavity. Instead, the design of the case (interchangeably referred to herein as a "body") of the card holder accommodates a specifically dimensioned and substantially parallel to the bottom portion actuator platform that is supported by the same two side walls at a level that is below the level of (or a plane defined by) the top portion of the case. At least a part of the actuator platform may be configured to extend (while in parallel to the bottom portion) under the surface of the top portion, thereby forming a slot-like pocket between the actuator platform and the top portion. Here, a long arm of a card actuator (having a generally J-shaped member) is judiciously positioned to substantially rest on (be supported at least from below by) the actuator platform and to slide reversibly towards and away from the front opening of the body over the actuator platform (with the end of the long arm entering and occupying the slot-like pocket at least in one position of the card actuator), while the short arm of the J-shaped member hangs over the actuator platform and faces the main internal cavity—and, in particular, a back opening at a back end of the body—at all times, whether or not such back opening is covered by the back cover.

Generally, the body of the holder is dimensioned such that two side wall connect the upper outer surface of the top portion of the body with the lower outer surface of the bottom portion of the body spatially uninterruptingly and, in at least one embodiment, the body of the card holder is configured as a monolithic body.

FIG. 1 schematically illustrates a plan view of the fully assembled embodiment 100 of the invention, showing a body 110, 1 with the top portion 114; a back cover 120, 15 installed; and a plurality of actuators 130, 4.

Figure 2:
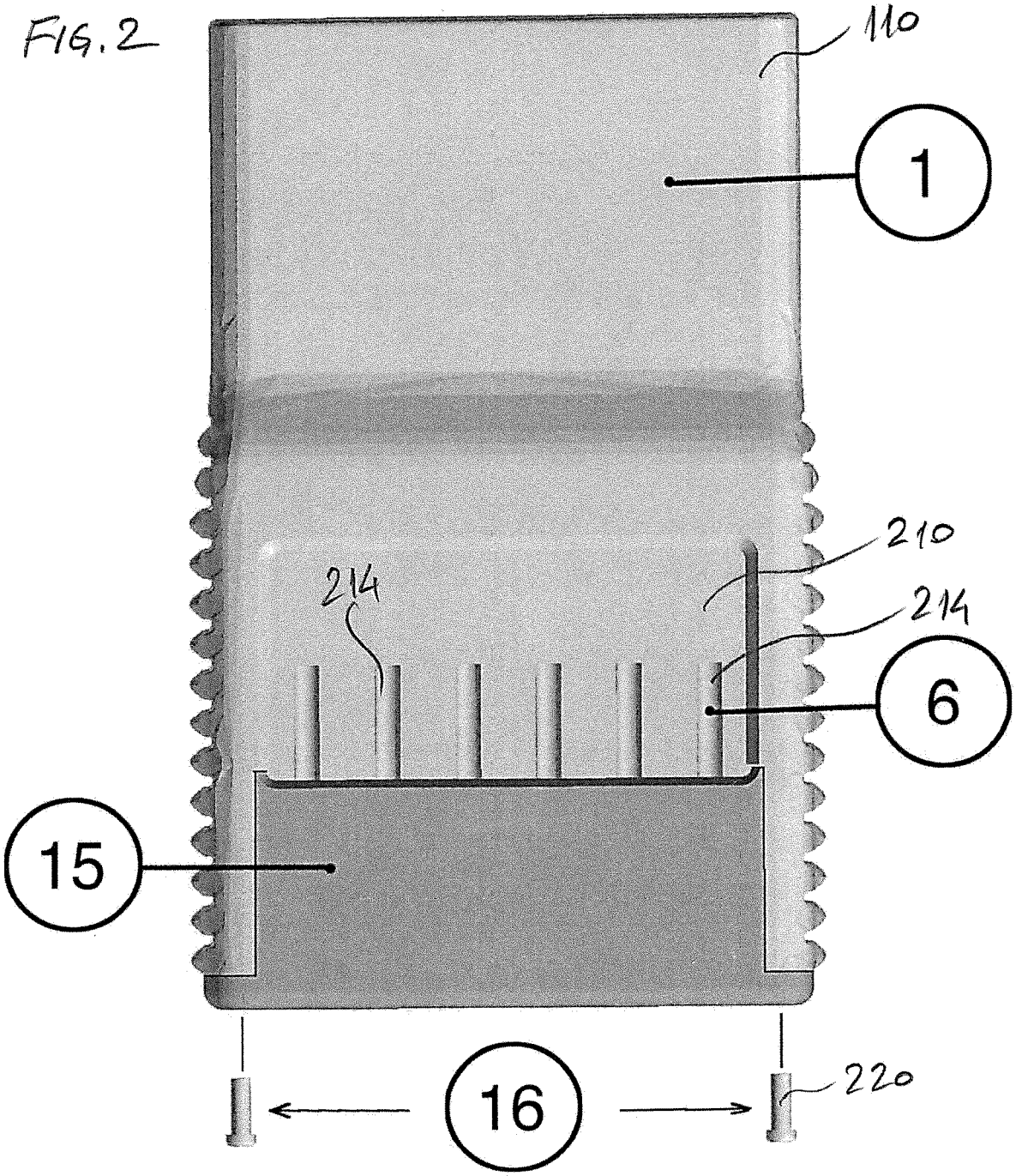
FIG. 2 provides the top view of a portion of the embodiment.

FIG. 2 displays a portion of the embodiment 100, from which the plurality of actuators 130 have been removed to expose the actuator platform 210 located under/below the actuators 130 and grooves 214, 6 in the top surface of the actuator platform 210. Fasteners 220, 16 (shown here separately from the body 110 as screws or bolts) may be used to affix the back cover 120 to the body 110.

Figure 3:
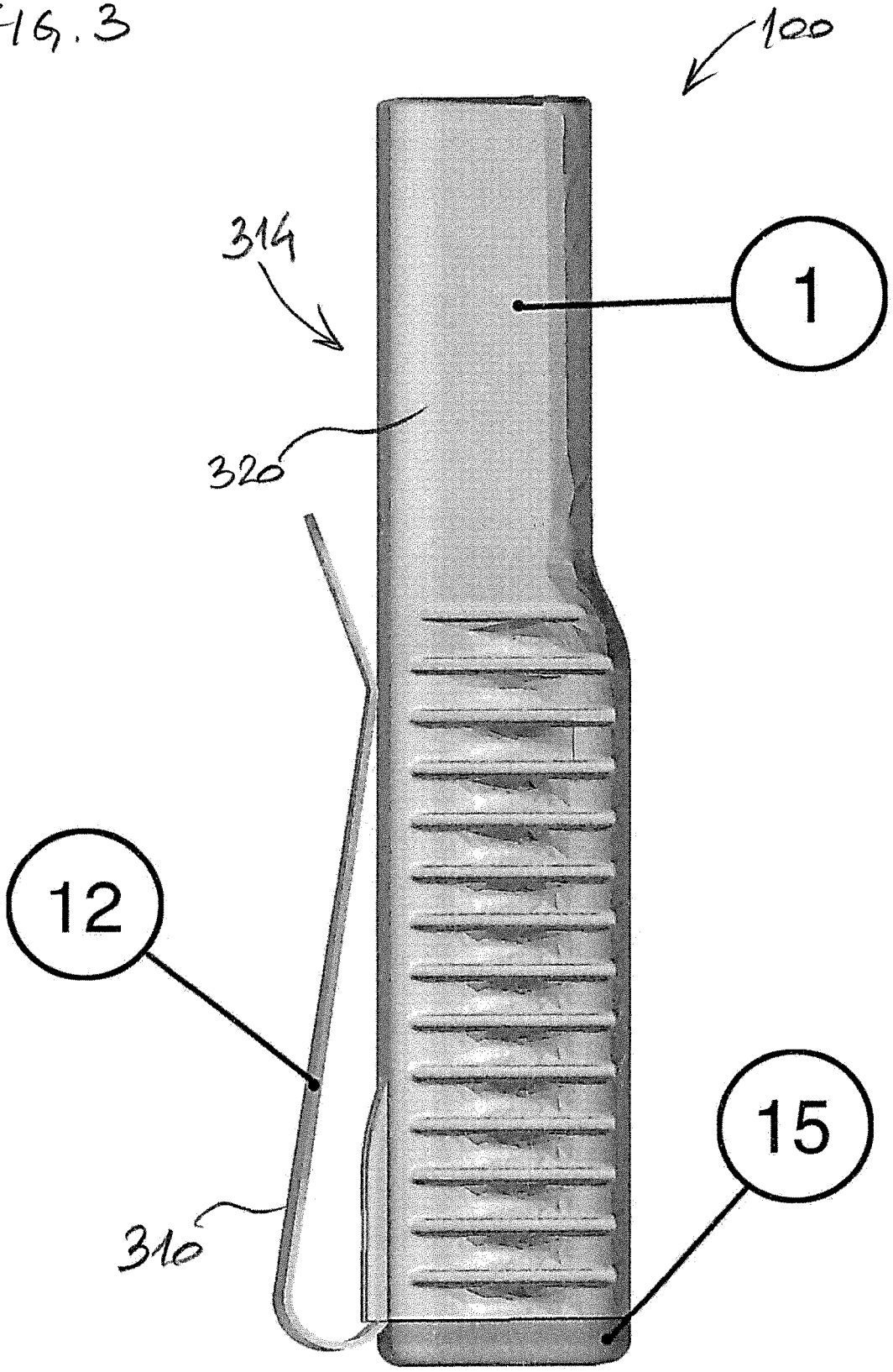
FIG. 3 is a side view of the embodiment.

FIG. 3 illustrates the embodiment 100 of FIG. 1 in side view (with the optional, dis-attachable clip 310 at the bottom portion 314 of the body 110,1) such that one side wall 320 of the two side walls of the body 110 is clearly observed. At portion of the side wall 320 may be optionally configured to carry a surface relief structure (as shown in this example—a portion of the side wall extending side-by-side with the actuator platform or plate 210) that is useful for gripping the card holder. As will be discussed in more detail below, it is this portion of the side wall that preferably includes a through-openings dimensioned to house and hold, removably, resilient pads (pads made of a resilient material) that are dimensioned to protrude into the internal volume of the body 110.

Figure 4:
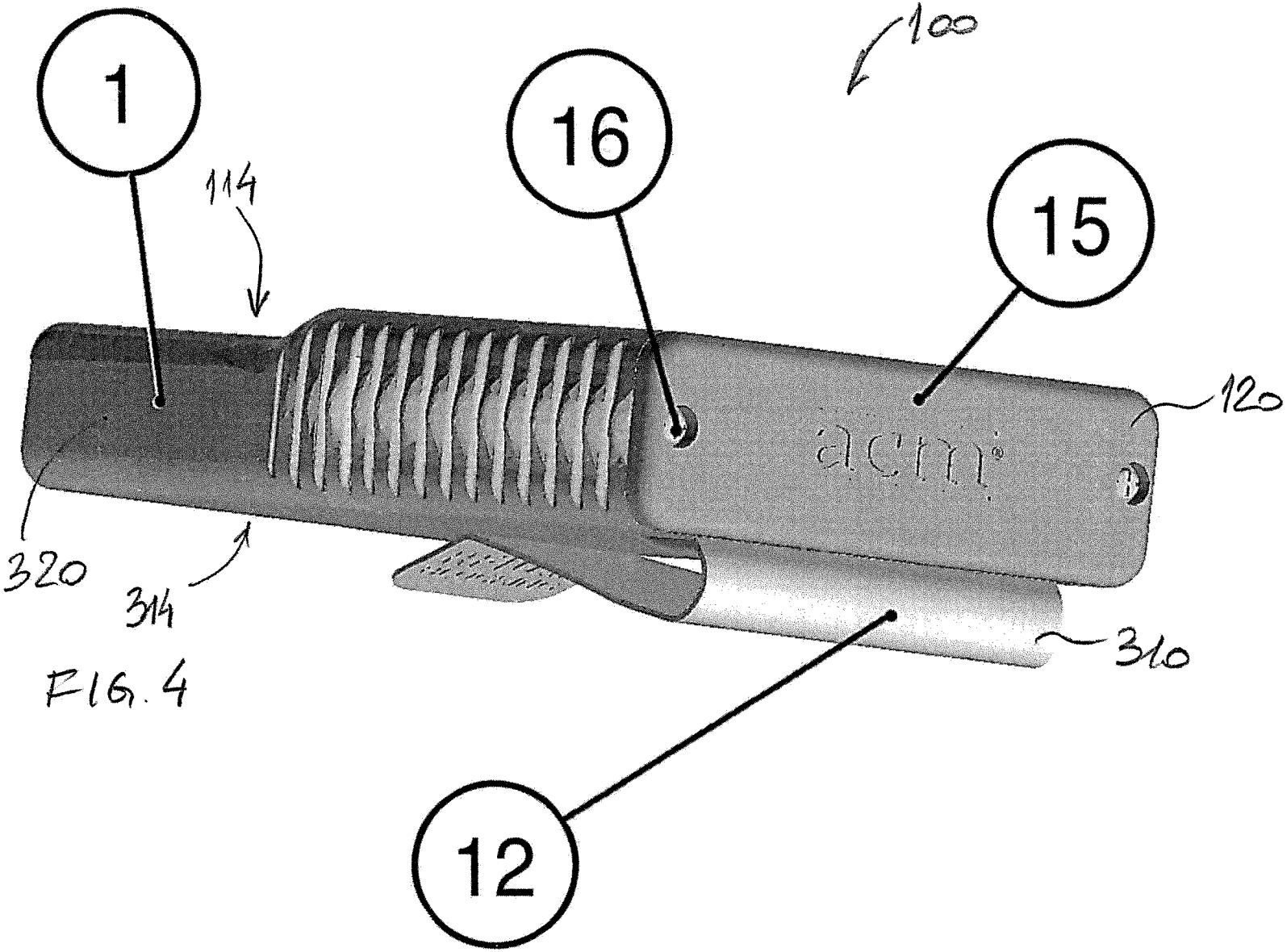
FIGS. 4 and 5 provide, respectively, perspective views of the assembled embodiment and of a portion of the embodiment of the card holder.

FIG. 4 provides an isometric view of the assembled embodiment 100 of the invention.

Figure 5:
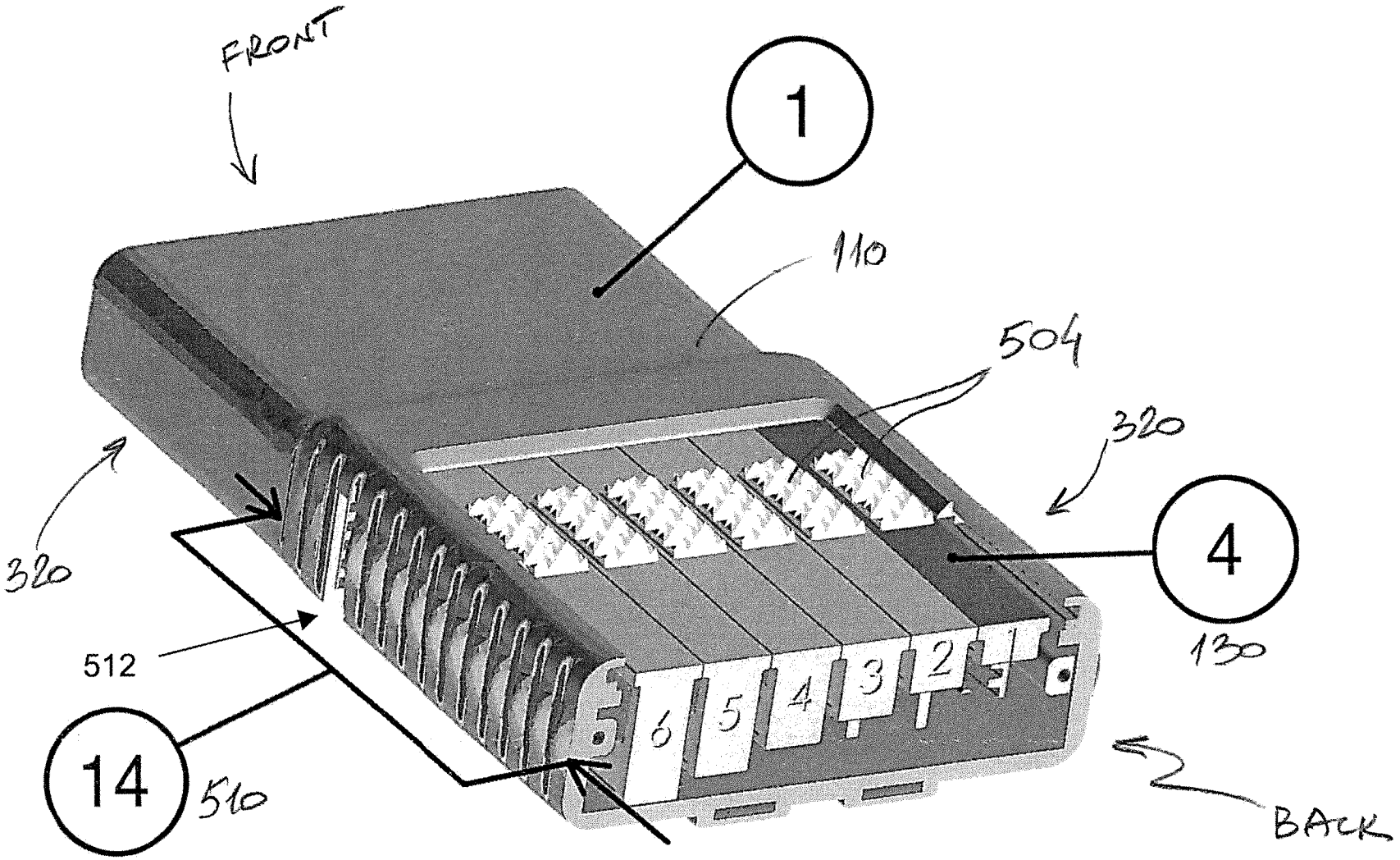

FIG. 5 is another isomeric view of the embodiment 100. Here, the embodiment 100 is shown with the back cover 120 removed to expose back ends of multiple actuators 130, 4. (Generally, substantially in every implementation of the holder, the back cover is dimensioned to be removably attached to the body by sliding the top of the back cover between the two side walls to sandwich a portion of the present actuator(s), which has(have) been engaged with the body, between the back cover and the back end of the body.) In the view of FIG. 5, the side walls 320 are shown to be equipped with the surface relief structure (side grips) 510, 14 that may be dimensioned as ridges/ribs extending transversely to the top/bottom portions of the body of the embodiment. The side grip 510, 14 exposed in FIG. 5 to the viewer is seen to include a slot/opening 512 formed through the side wall 320. (The through-opening or slot 512 is dimensioned to hold a resilient clutch pad which is not shown here but is later described in reference to FIG. 6). The back ends of multiple card actuators 130,4 (each back end carrying a respectively corresponding numeral, 1 to 6) are shown to face the (removed) back plate 120, and each of the top surfaces of the long arms of the multiple card actuators carries an integrated surface relief 504 ("a sharktooth grip") configured to be contacted and pushed along the top portion 110 and over the actuator platform 210 (located under these long arms) by the user's finger in operation of the card holder.

Figure 6:
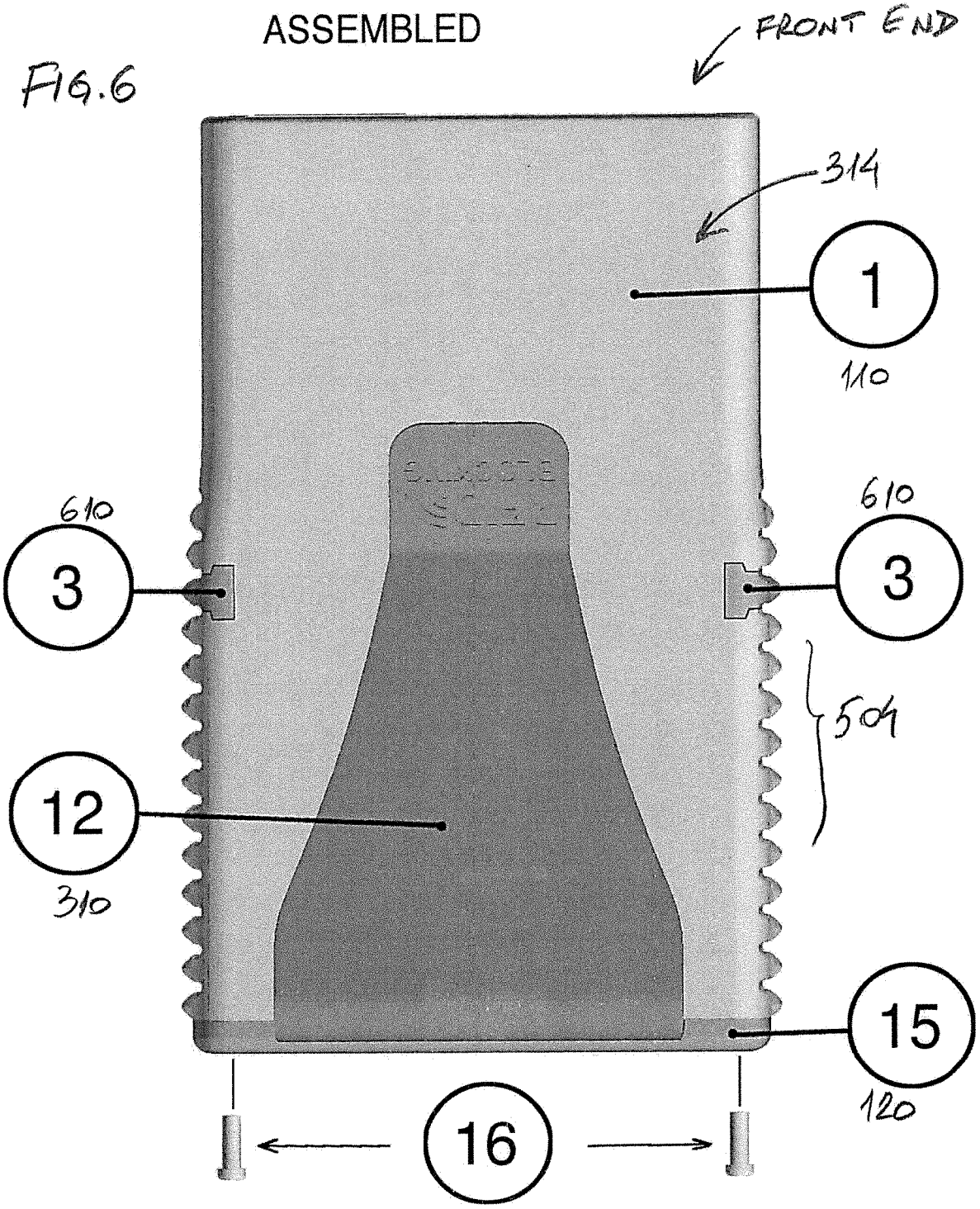
FIG. 6 is a bottom view of the assembled embodiment of the invention.

FIG. 6 schematically illustrates the plan view of the embodiment 100 from the bottom, with the outer surface of the bottom portion 314 facing the viewer, with resilient-material pads 610, 3 now installed in and held within the corresponding through-openings 512 in the side walls 314 between the neighboring elements of the surface relief structures 510, 14.

Figure 7:
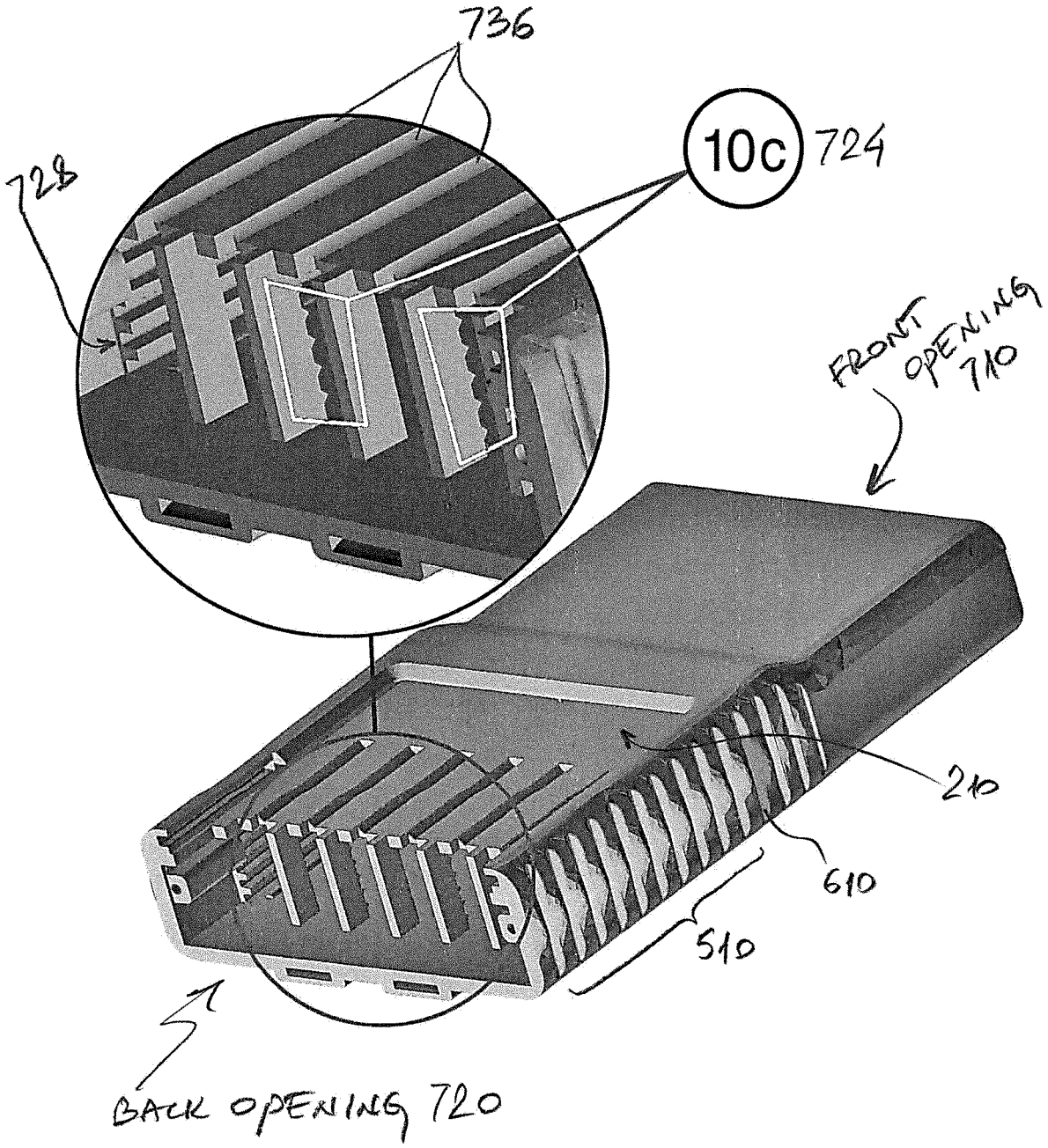
FIG. 7 and inset illustrate a case (body, main chassis) portion of the embodiment of the invention in a perspective view.
Figure 8:
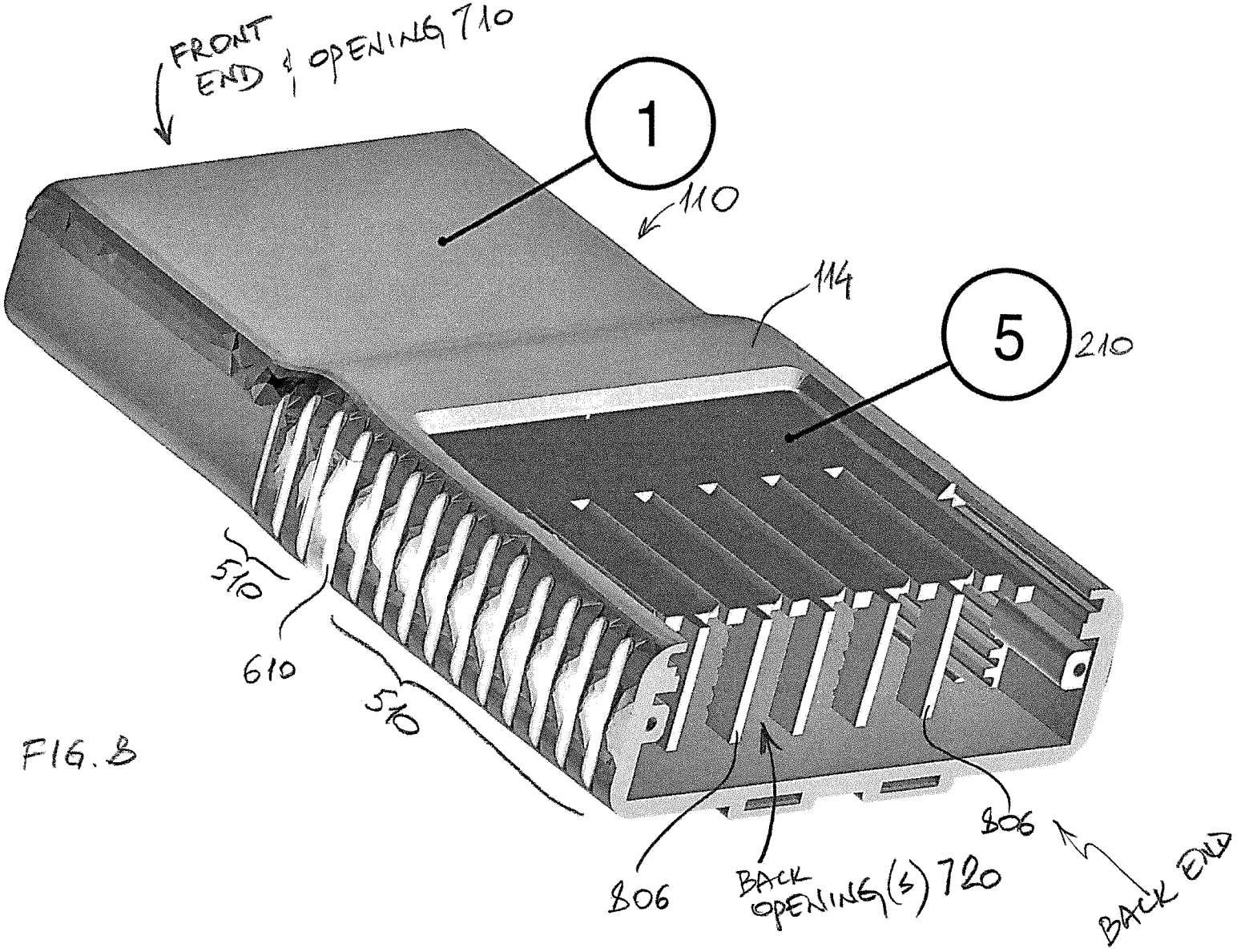
FIGS. 8, 9 depict the main chassis of the embodiment in another perspective view, with the resilient clutch pads assembled with and separated from the main chassis, respectively.

The inner workings of the embodiment 100 can be appreciated from FIGS. 7 and 8, which provide schematic illustrations of the body (also referred to interchangeably as "main chassis") of the embodiment of the car holder of the invention, with both the actuators and the back plate removed. As illustrated, the actuator platform 210 is configured to be substantially parallel to the lower outer surface of the bottom portion 314 and is located between the bottom portion 314 and the upper outer surface of the top portion 114 (at a level below that of the upper outer surface of the top potion 114). The lower surface of the actuator platform 210, the inner surfaces of the side walls 320, and the upper surface of the bottom portion 314 (which upper surface of the bottom portion is directly facing the lower surface of the actuator platform) limit an define the main interior cavity of the body 110. This cavity has a front opening 710 at the front end of the embodiment 110 and a back opening 720 at the back end thereof. (Notably, as shown in FIG. 4, for example, when the back plate or cover 120,15 is installed and affixed to the body 110, the back opening 720 is closed by the back plate 120, 15).

In at least one implementation, shown in FIGS. 7 and 8, the back edge of the actuator platform 210 facing the back opening 720 may be optionally supported by at least one support stop element 806 (a support stop. For short) to even further increase the rigidity of the construction such as to substantially completely eliminate a possibility of vertical movement of the back edge of the platform 210 in response to pressure applied to the upper surface of the platform 210. Notably, when at least one support stop 806 is present, such support stop is preferably monolithically integrated with the actuator plate 210 and the upper surface of the bottom portion 314, and the number of the back opening(s) 720 becomes greater than one. The skilled artisan will now readily appreciate that the actuator platform 210 is supported by and extends (substantially parallel to the lower outer surface of the bottom portion 314) between the two side walls 320, and that the actuator platform 210 is separated from the bottom portion 314 by a distance that is shorter than a height of a side wall 320. A lower surface of the actuator platform 210, an upper internal surface of the bottom portion 314, and inner surfaces of the two side walls 320 limit and define an interior cavity of the body with a front opening at a front end of the body and at least one back opening at a back end of the body.

Furthermore, in this specific case—that is, when at least one support stop 806 is present—at least one of such support stops can be equipped with a surface relief 724, 10*c* (shown as "teeth" in inset of FIG. 7) at its edge surface that faces the main internal cavity. In at least one case, such surface relief 724, 10*c* can be dimensioned to form grooves that are substantially parallel to the actuator platform 210 and the upper surface of the bottom portion 314. These grooves are configured as stoppers limiting the movement of the cards housed in the internal main cavity of the embodiment 110 and installed (inserted) to such cavity from the open front end of the embodiment 110.

Optionally but preferably, each of the internal surfaces of the side walls 320 is dimensioned to carry (contain thereon) one-to-one corresponding and spatially aligned with one another and substantially parallel to one another slots or grooves 728 that extend in a direction of the front opening 710, that are spatially aligned with corresponding actuators (as will be shown below in FIGS. 10A, 10B, 10C, and 10D), and that are dimensioned to support the cards inserted through the opening 710.

In one case, when the embodiment 110 is equipped with both at least one support stop 806 and a pair of respectively corresponding to one another and facing each other grooves 728 on the opposite side walls 320, grooves 728 of such a pair and a respective groove 724 formed by the "teeth" on the support stop 806 configured to be lying in the same plane (that is, be substantially co-planar), thereby providing mechanical support to a card inside the internal cavity at three of the four sides of the card. In a related case, when the embodiment 110 does not contain any optional support stop 806, the internal surface of the back cover 120 may be structured to contain structural features providing mechanical support to card(s) at the back end of the embodiment.

Notably, the upper surface of the actuator platform or plate 210 contains a plurality of grooves labelled in FIG. 7 with the numeral 736 and shown in FIG. 4 as grooves 214. The number of these grooves generally corresponds to the number of the actuators (which is further discussed below).

Figure 9:
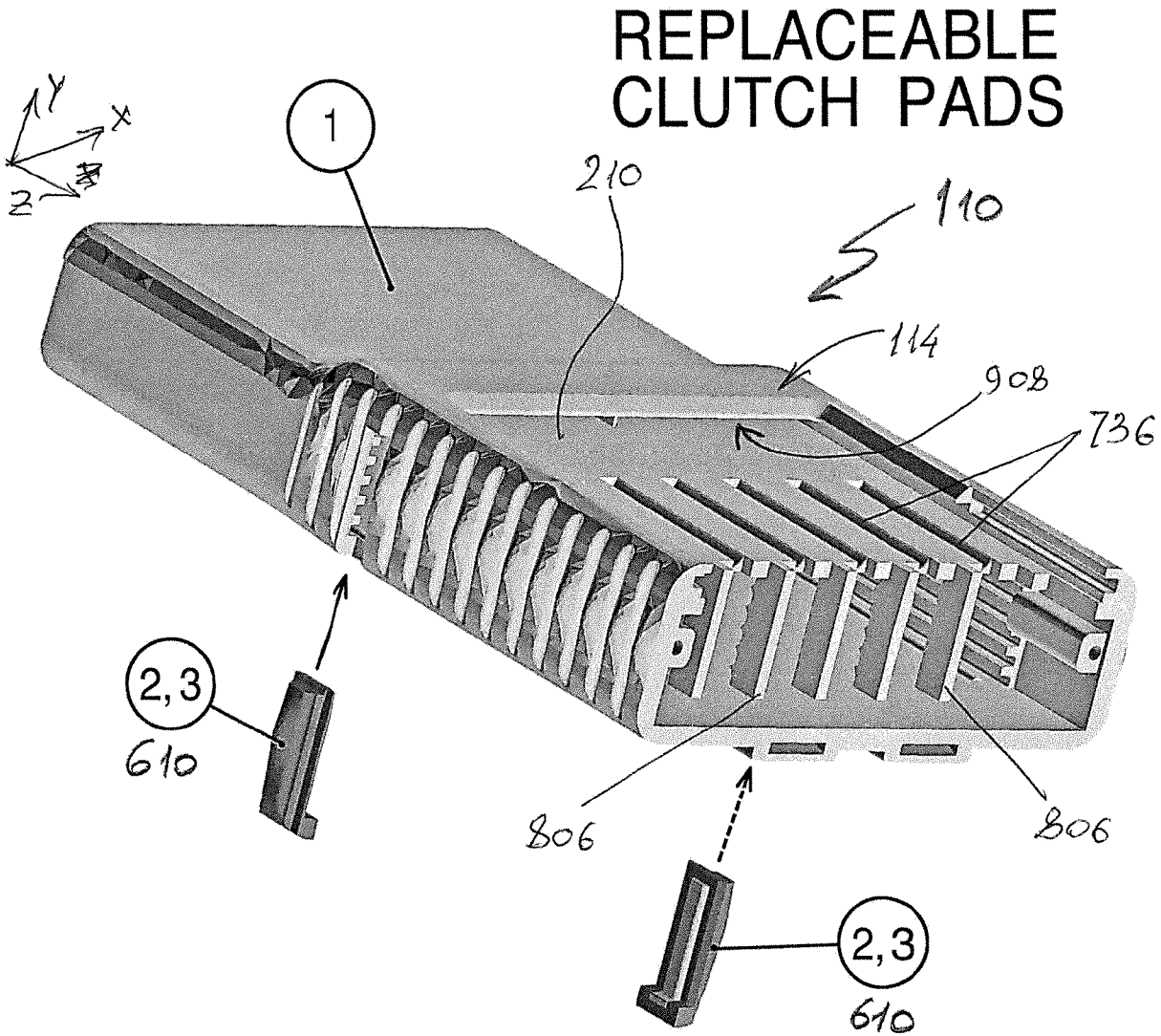
Figure 10A:
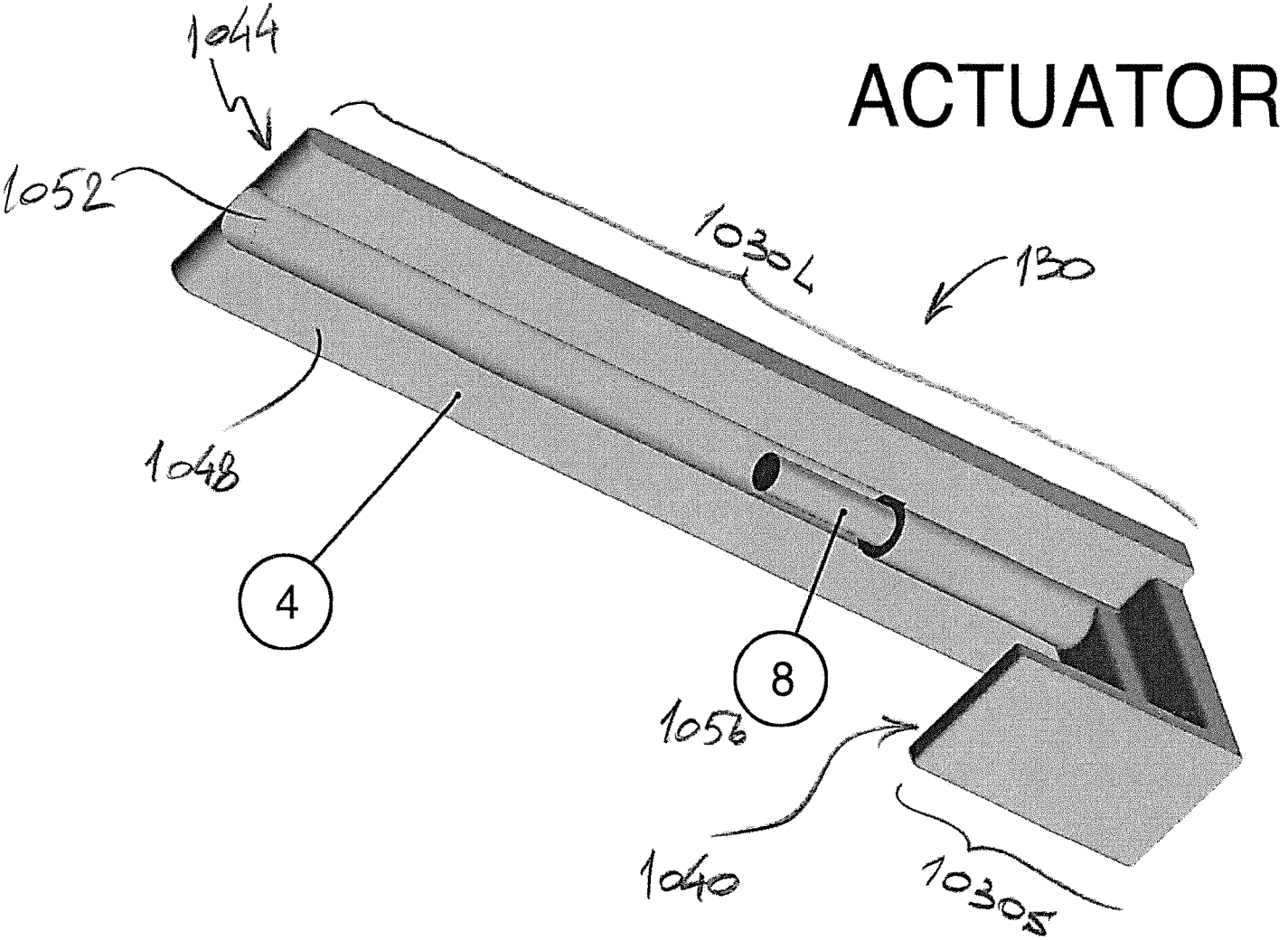
Figure 10B:
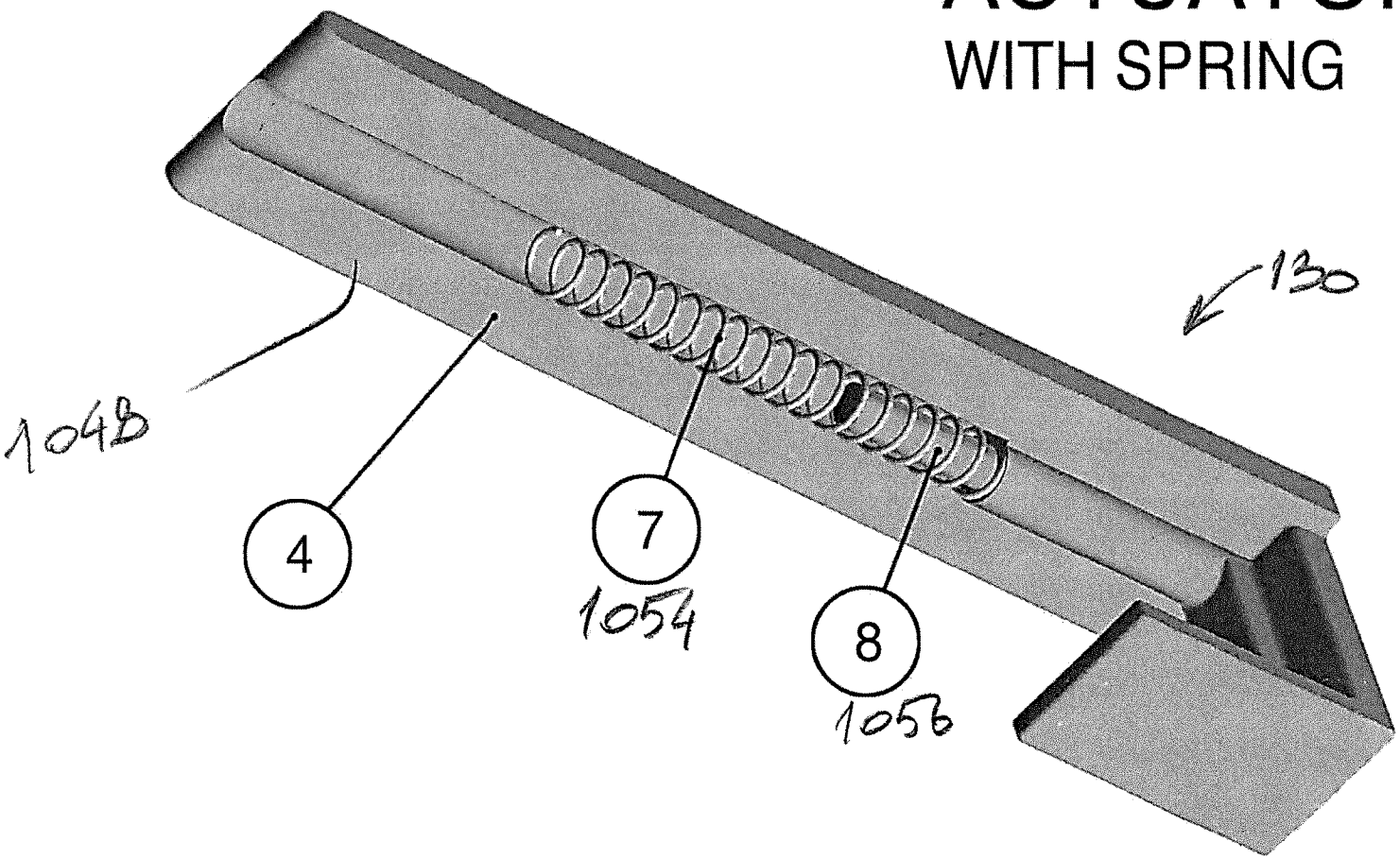
Figure 10C:
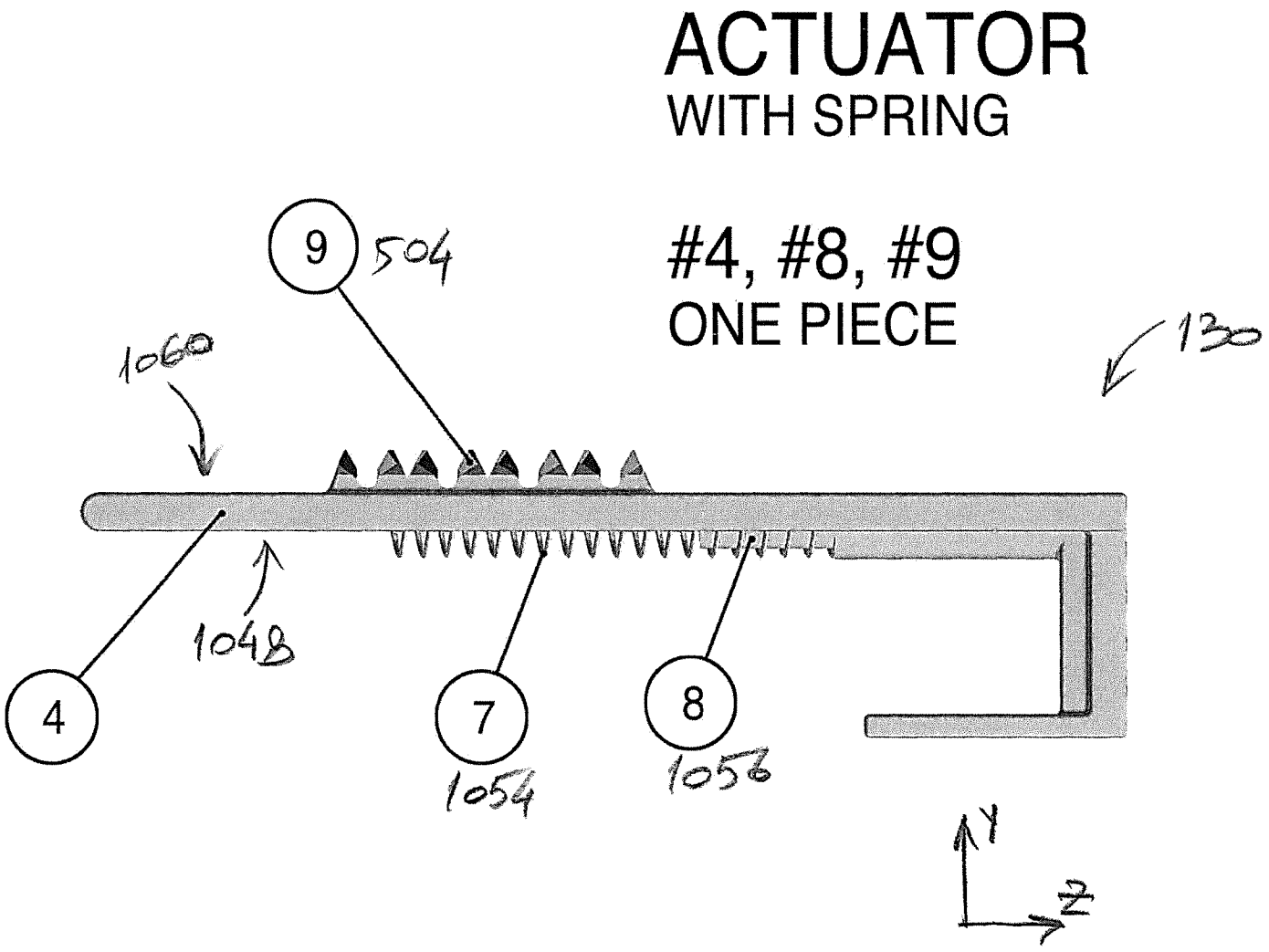
Figure 10A:
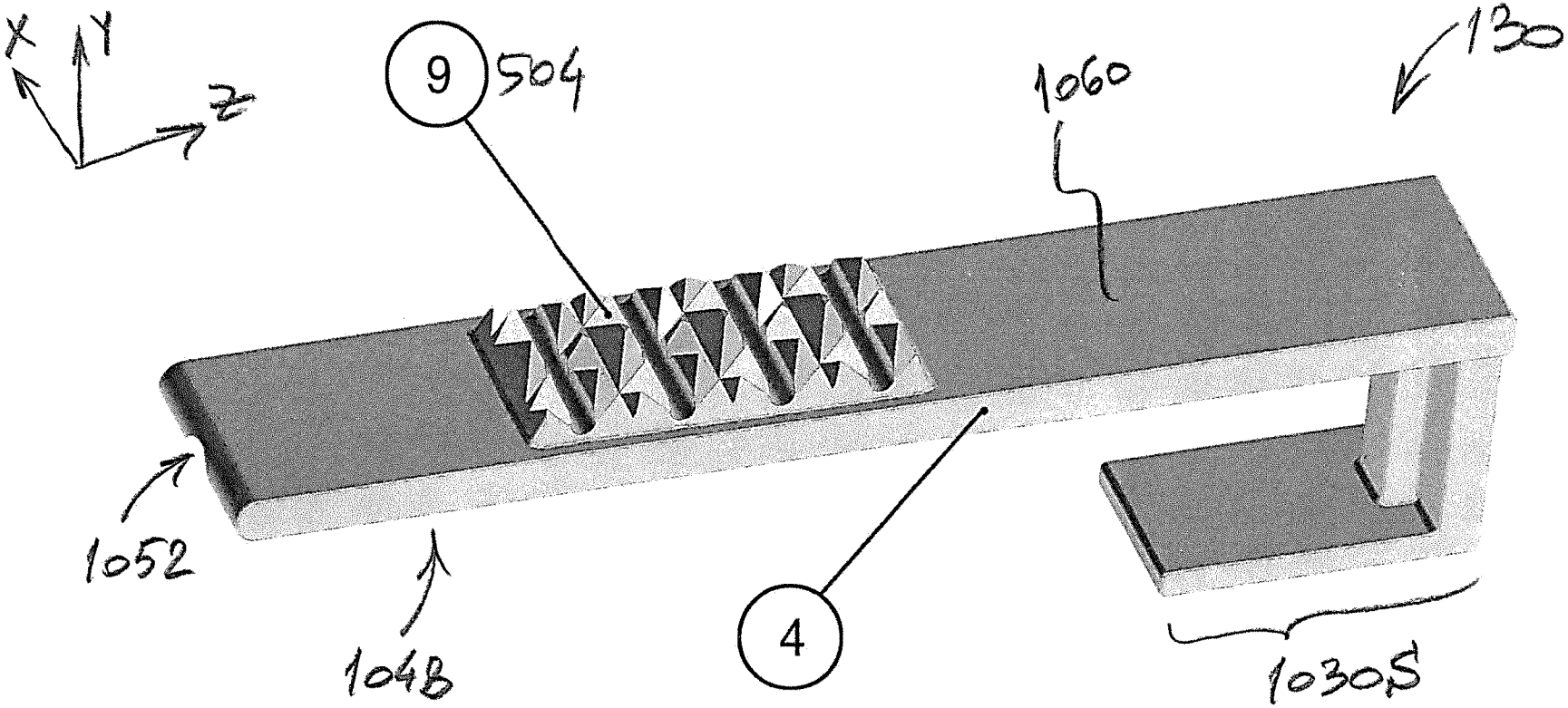

FIG. 9 provides yet another isometric view of the embodiment 110. Here, as shown, the upper surface of the actuator platform 210 is spatially (vertically) separated from the upper outer surface (as well as lower inner surface) of the top portion 114—with the platform 210 extending towards the back end of the embodiment 110 farther than the top portion 114 (as has been already illustrated in FIGS. 7 and 8)— thereby forming a slot-like pocket 908 between the actuator platform 210 and the top portion 114. In at least one specific case, the height (extent along the local y-axis) of this pocket 908 is specifically dimensioned to house the ends of the card actuators (which is further discussed in reference to FIGS. 10A, 10B, 10C, and 10D).

Understandably, the combination of the top portion 114 of the body 110 and the actuator platform 210 of the same body can be alternatively described as an upper plate of the body 210 that (upon extending from the front of the body 110 towards the back of the body 110) bifurcates into two subplates: one forming the actuator platform 210 and another, located above the platform 210, forming the "visor" with an overhang above the platform 210. Understandably, the upper subplate forming an overhand above the lower subplate (platform 210) is located farther away from the bottom portion 314 of the body of the embodiment. The upper subplate does not reach as far towards the back end of the body 110 as the lower subplate thereby exposing the grooves 736 in the lower subplate (platform 210) for view when the actuators are not installed yet or removed.

Structural details of an actuator 130 of the embodiment are now discussed in reference to FIGS. 10A, 10B, 10C, and 10D. A given actuator 130, 4 is configured to be slidably and reversibly movable along an axis of the body 110 (towards and backwards with respect to the front opening 710 of FIG. 7) above (and supported from below by) the upper surface of the actuator platform 210. The actuator 130 includes a J-shaped member having a long arm 1030L and a short arm 1030S, and an end 1040 that is configured to engage at least one card (when the card is housed within the main interior cavity of the body 110) to reposition such card along the axis of the body 110. The other end 1044 (the front end, or the end of the log arm 1030L) is dimensioned to move in an out of the slot-like pocket 908 (FIG. 9) formed between the top portion 114 and the actuator platform 210. The lower surface of the actuator 130, 4 (the surface facing, in the assembly 100, the upper surface of the platform 210) may optionally contain a groove 1052 respectively-corresponding to one of the optional grooves 736 in the upper surface of the platform 210. When both grooves 736, 1052 are present, and when the actuator 130 is positioned with its long arm 1030L on top of the platform 210 and with its short arm 1030S below the platform 210 (see FIG. 5), the groove 1052 is positioned substantially directly above the corresponding groove 736 to from an elongated space (extending along the axis of the body) therebetween. This arrangement simplifies the accommodation of the corresponding compression spring 1054, 7 (which may be optionally secured at the base of the J-shaped member of the actuator 130 on or at a protrusion 1056, 8 formed at the long arm 1030L to extend along the lower surface of the actuator 130), and accordingly the grooves 736 are configured as actuator spring housing guides. In this case the protrusion 1056 may be judiciously dimensioned to operate as spring post—that is, to slidably fit within the compression spring 1054 and, in one specific case, may be shaped as a substantially cylindrical element. The upper surface of the actuator 130 is configured to contain the surface relief (gripper structure) 504, as discussed above.

As the person of ordinary skill in the art will now appreciate, generally a given actuator is configured to slidably and reversibly move toward the front opening of the body (main chassis) above and along the upper surface of the actuator platform 210.

Figure 11A:
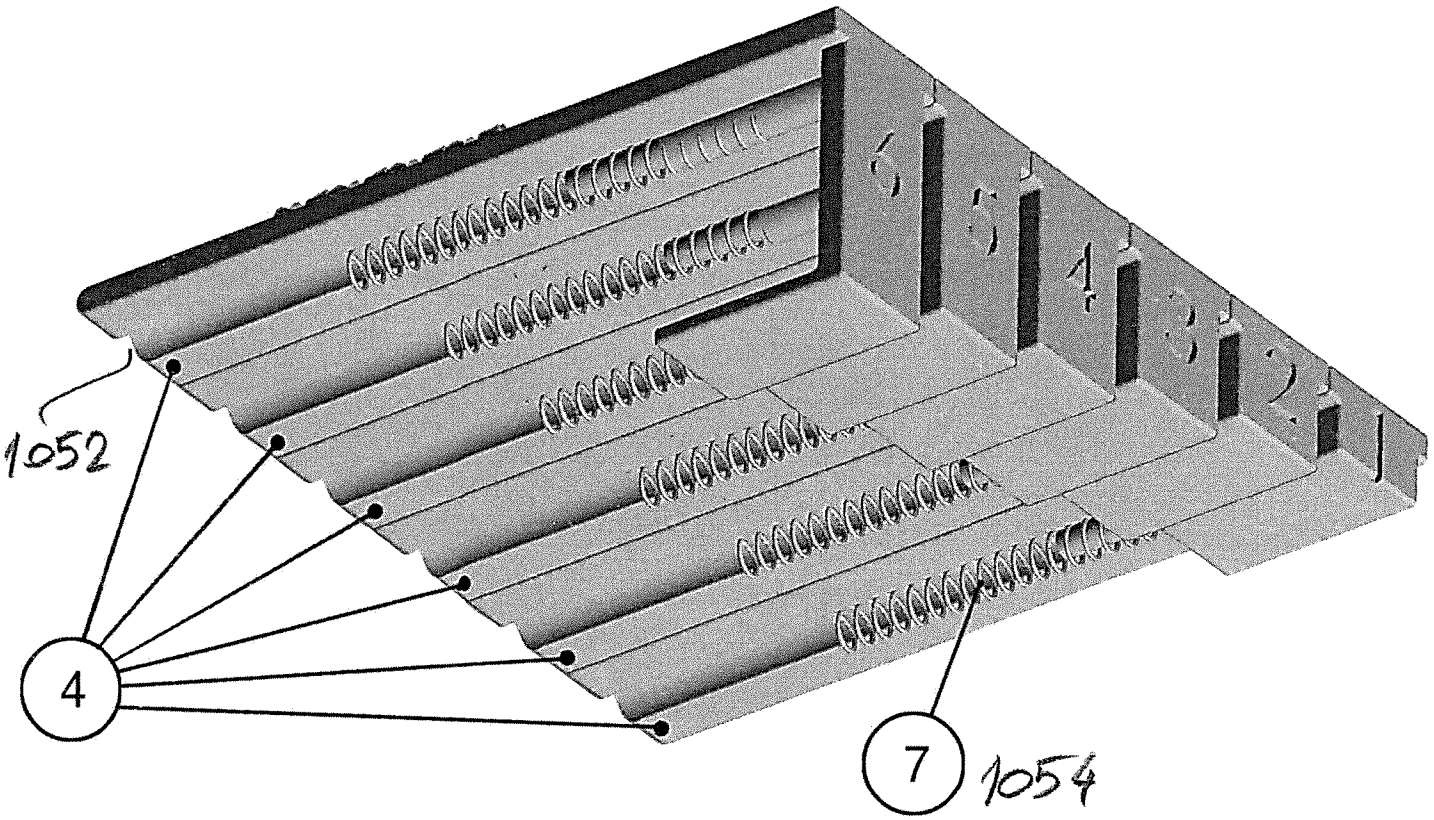
FIGS. 11A, 11B illustrate a group of ejection tab assemblies (actuators) optionally aggregately used, as a plurality, as part of an embodiment of the invention.
Figure 11B:
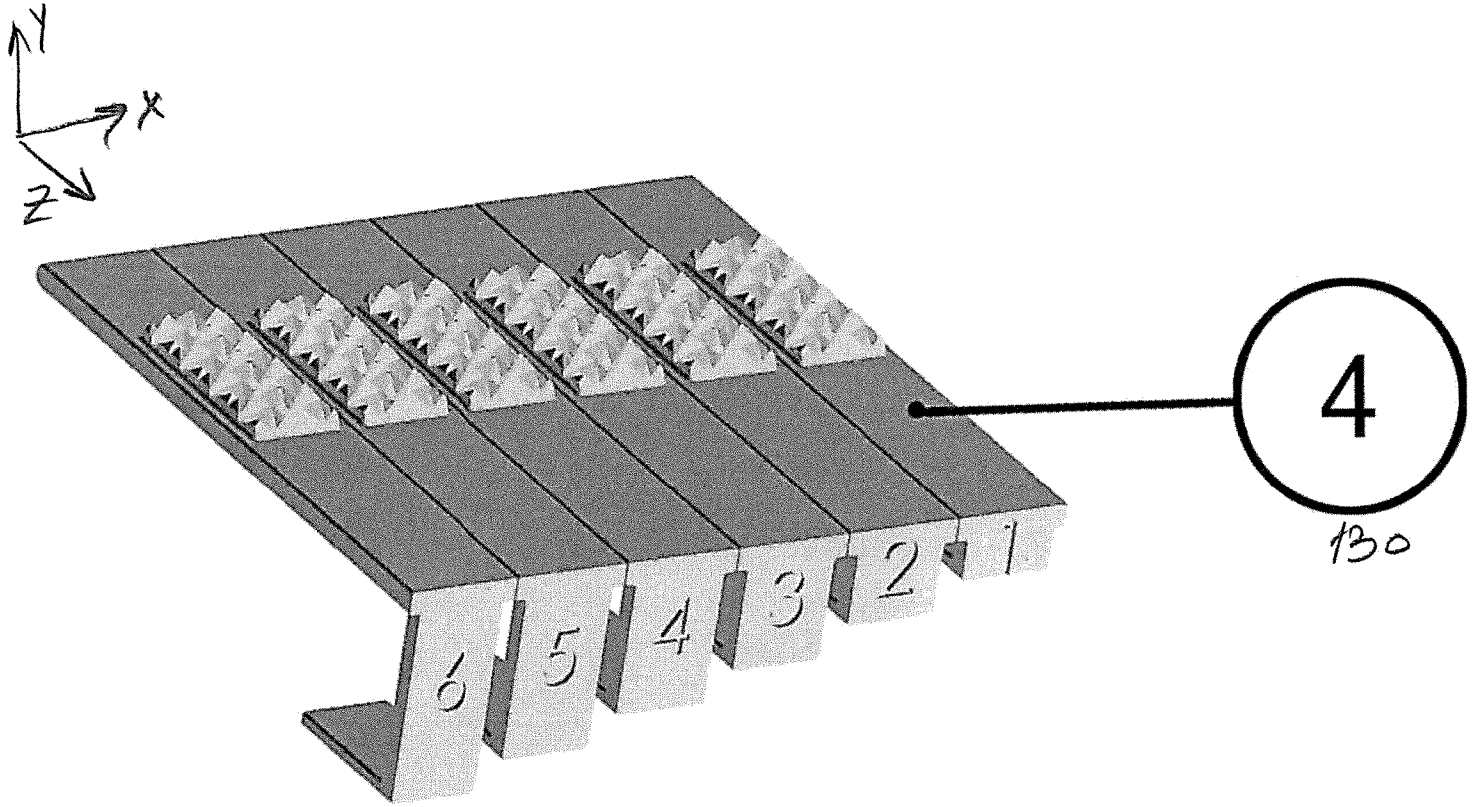

FIGS. 11A, 11B provide additional illustrations showing a plurality of the actuators 130. When multiple actuators 130 are used in the embodiment of the invention, such actuators are dimensioned to have corresponding short arms 1030S to be of different sizes to engage respectively-corresponding cards located at different levels within the main volume of the body of the embodiment 100. The skilled person readily appreciates that, when an embodiment of the holder includes a plurality of actuators, each actuator of such plurality is configured to slidably and reversibly move (above the upper surface of the actuator platform) toward the front opening in the body of the holder. Each actuator of the plurality of actuators includes a corresponding J-shaped member, and different J-shaped members of different actuators of the plurality of actuators may have different dimensions.

Figure 12:
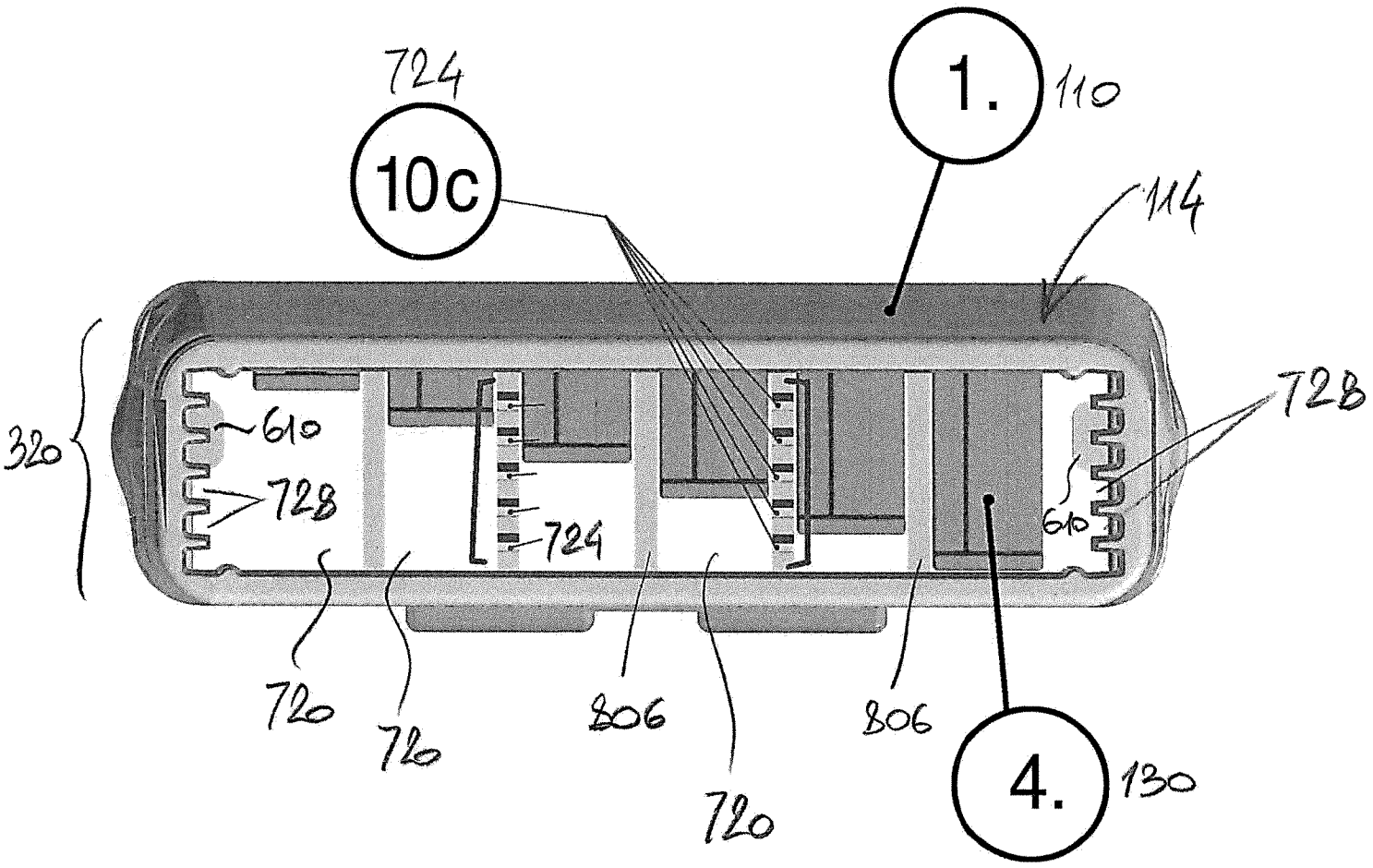
FIG. 12 illustrates the combination of the main chassis of the embodiment with the plurality of actuators as viewed from the front.

FIG. 12 is an isometric view of a portion of the embodiment 100 containing the body 110 with the plurality of actuators 130 and without the back plate 120. The actuator platform 210 is not visible in this Figure, being blocked from view by the top portion 114. However, the resilient (clutch) pads 610 protruding through the side walls 320 into the main volume of the embodiment are clearly indicated.

Figure 13A:
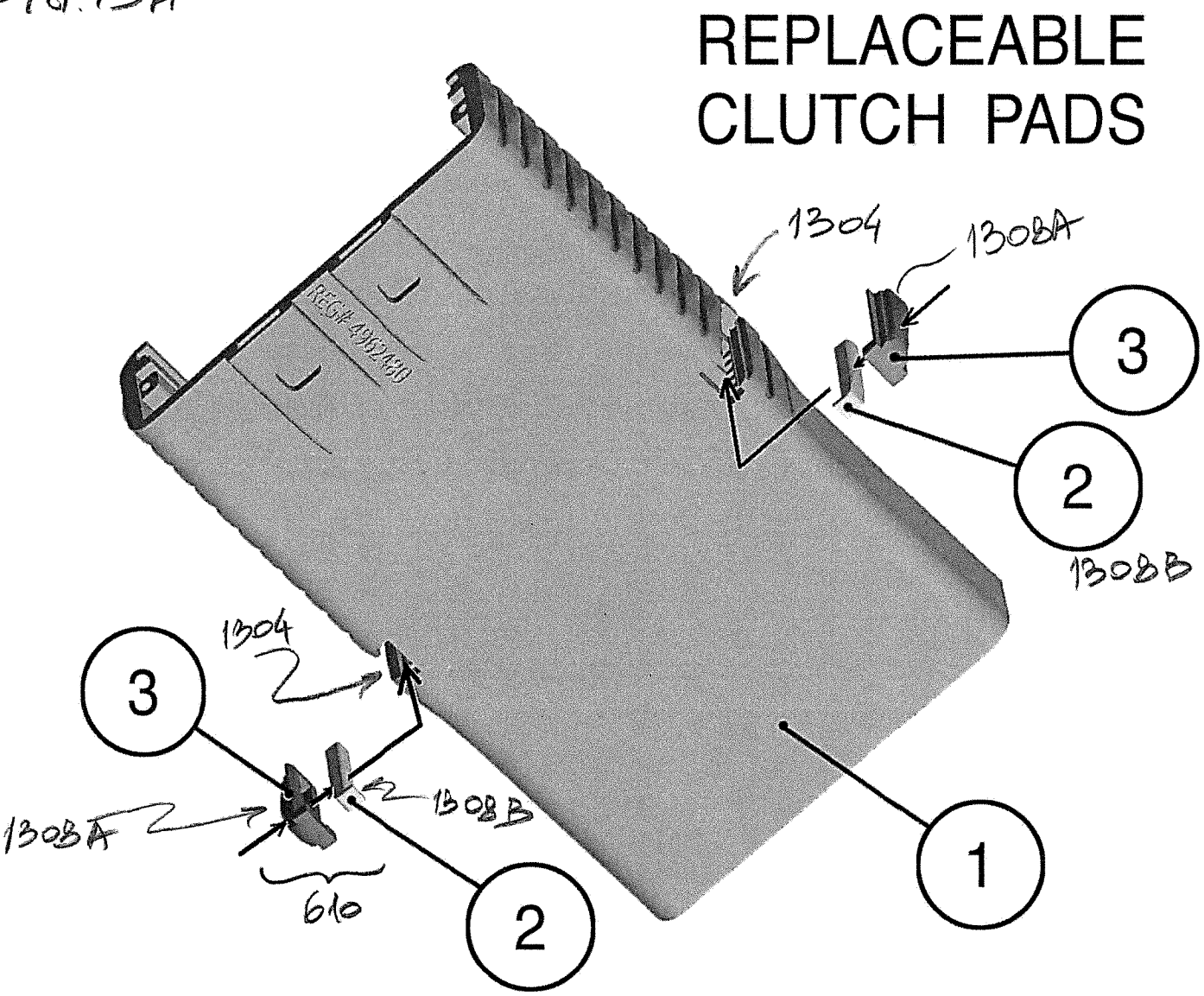
FIGS. 13A, 13B provide perspective views of the main chassis of the embodiment and, together with the views of FIGS. 8, 9, illustrate the use of the resilient pads of the embodiment in additional detail.
Figure 13B:
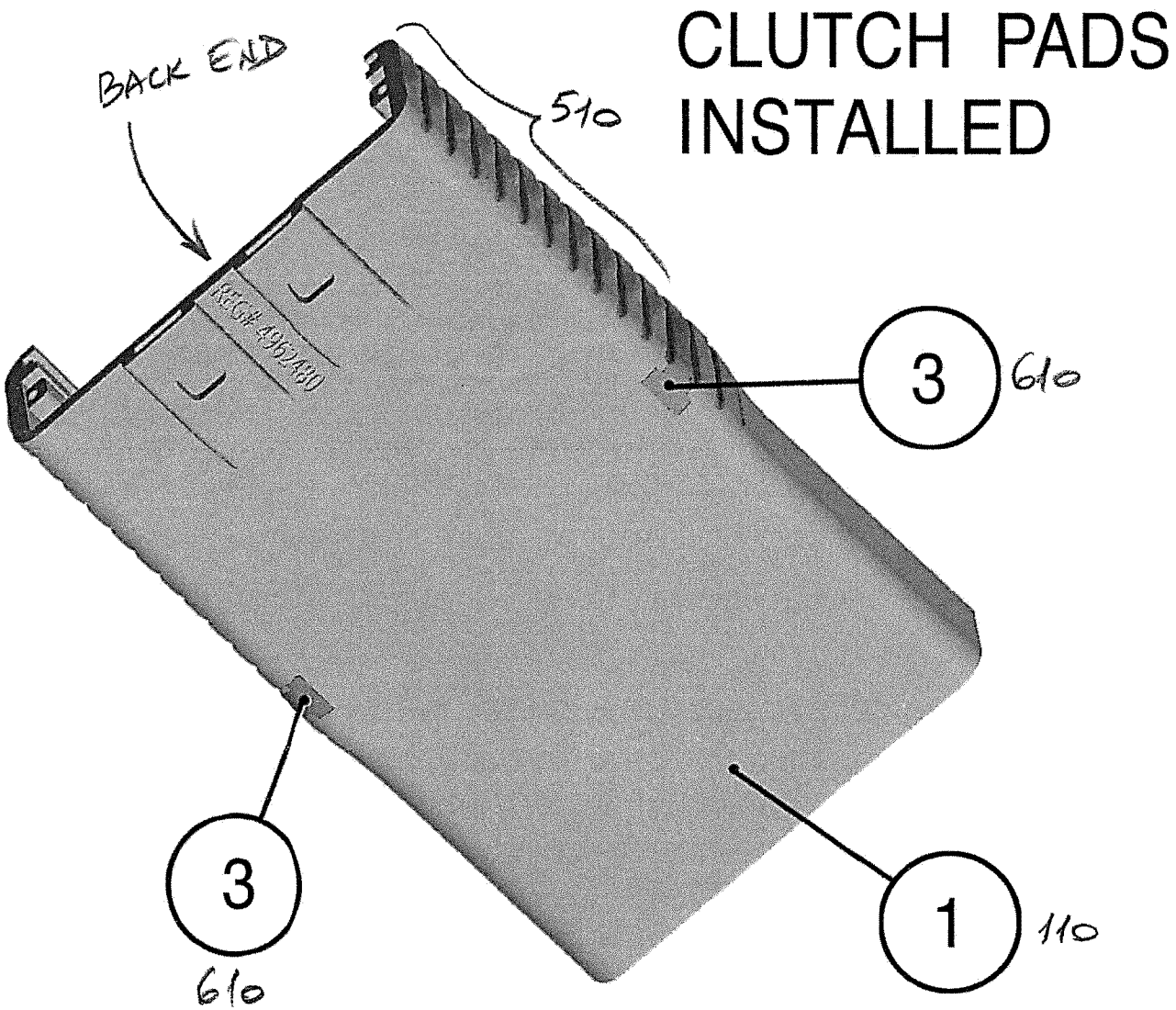

FIGS. 13A, 13B provide additional isometric illustrations depicting the through-openings 1304 in the side walls 320. The same through openings are illustrated as 512 in FIG. 5. The through-openings 1304 are dimensioned to accommodate the resilient pads 610 which, when removably inserted into the openings 1304, protrude into the volume of the internal cavity of the body 110 to frictionally engage the plurality of cards housed within the internal cavity. FIGS. 13A, 13B additionally illustrate one non-limiting implementation of the structure of the resilient pads 610 (which may, as shown, include corresponding pads housings 1308A and pad inserts 1308B).

Figure 14:
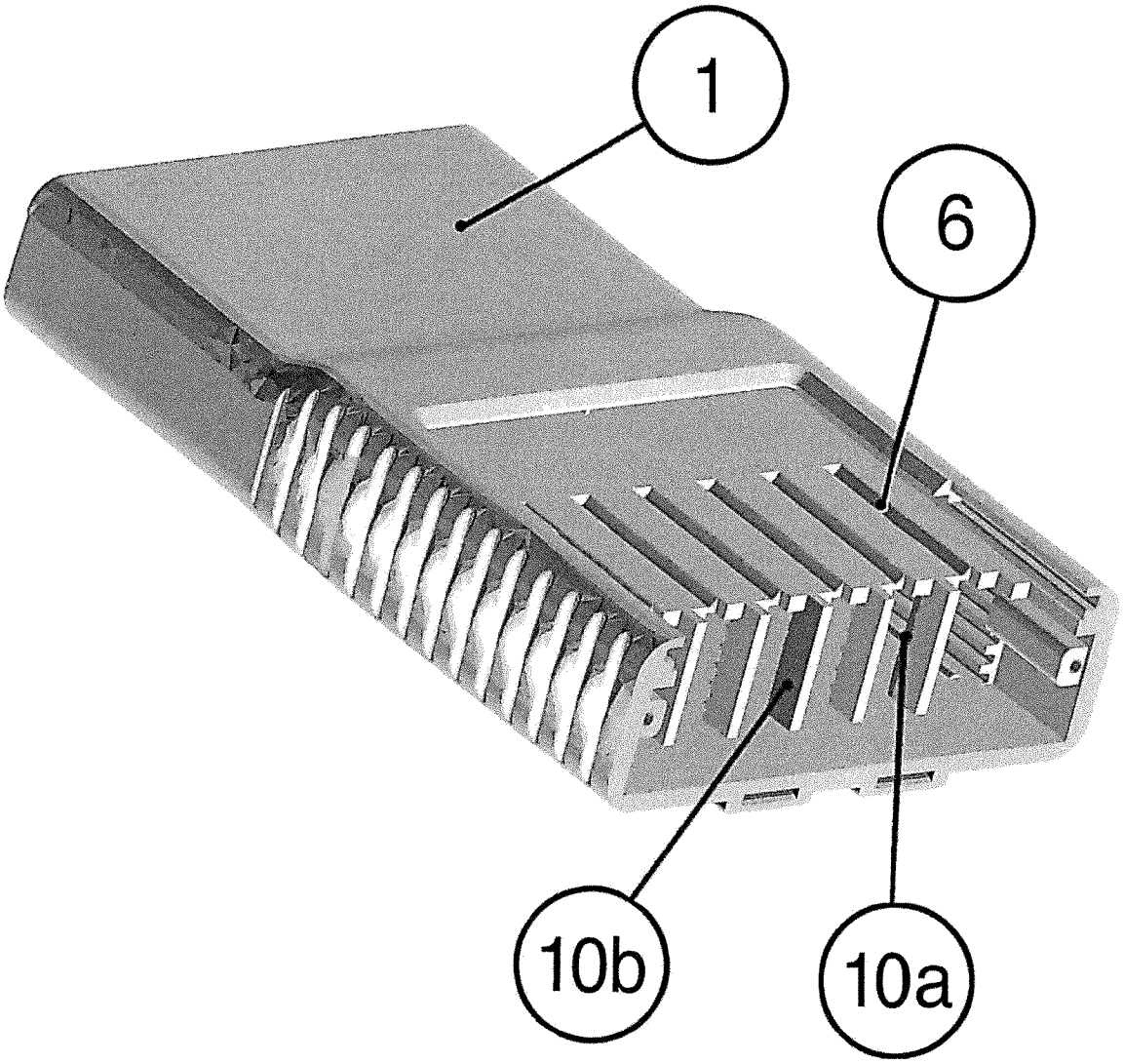
Figure 15:
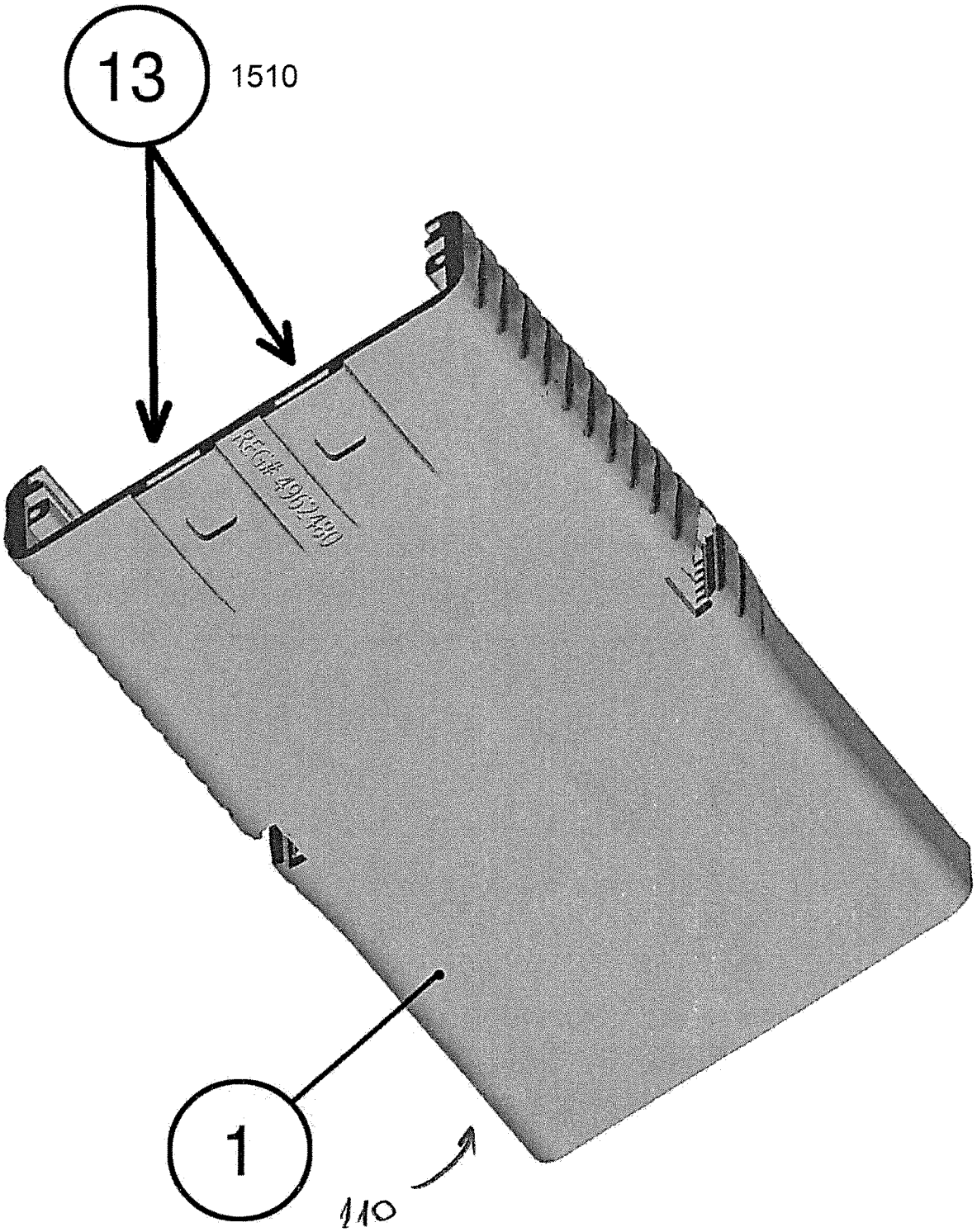

FIGS. 14, 15, and 16 illustrate additional details of and information pertaining to an embodiment of the invention. Element 1510, 15 designates optional clip mounts with which the embodiment may be equipped with the clip 310 is employed (see FIG. 3).

It is appreciated that an embodiment of the invention an be generally fabricated from substantially every material lending itself to molding (such as plastic) and/or machining (for example, CNC machining; such as metal, for example aluminum or titanium alloy or steel alloy of some sort). In at least one implementation, the holder may have outer dimensions of about 100 mm in length by 60 mm in width by 19 mm in thickness, and weight approximately 50-55 grams.

The skilled person having the advantage of information contained in this disclosure readily appreciates that various structural features of the above-discussed embodiment(s) that are structurally and/or operationally compatible with the features of the embodiment(s) discussed in U.S. Pat. No. 7,267,147 without degrading the operation of the above-discussed embodiments may be, indeed, so combined, thereby resulting in related and non-limiting embodiments, each of which is within the scope of the present invention.

For the purposes of this disclosure and the appended claims, the expression of the type "element A and/or element B" has the meaning that covers embodiments having element A alone, element B alone, or elements A and B taken together and, as such, is intended to be equivalent to "at least one of element A and element B".

References throughout this specification to "one embodiment," "an embodiment," "a related embodiment," or similar language mean that a particular feature, structure, or characteristic described in connection with the referred to "embodiment" is included in at least one embodiment of the present invention. Thus, appearances of the phrases "in one embodiment," "in an embodiment," and similar language throughout this specification may, but do not necessarily, all refer to the same embodiment. It is to be understood that no portion of disclosure, taken on its own and in possible connection with a figure, is intended to provide a complete description of all features of the invention. Within this specification, embodiments have been described in a way that enables a clear and concise specification to be written, but it is intended and will be appreciated that embodiments may be variously combined or separated without parting from the scope of the invention. In particular, it is appreciated that all features described herein are applicable to all aspects of the invention.

When the present disclosure describes features of embodiments of the invention with reference to corresponding drawings (in which like numbers represent the same or similar elements, wherever possible), the depicted structural elements are generally not to scale, and certain components may be enlarged or reduced in size relative to the other components for purposes of emphasis and understanding. It is to be understood that no single drawing is intended to support a complete description of all features of the invention. In other words, a given drawing is generally descriptive of only some, and generally not all, features of the invention. A given drawing and an associated portion of the disclosure containing a description referencing such drawing do not, generally, contain all elements of a particular view or all features that can be presented is this view, at least for purposes of simplifying the given drawing and discussion, and directing the discussion to particular elements that are featured in this drawing. A skilled artisan will recognize that the invention may possibly be practiced without one or more of the specific features, elements, components, structures, details, or characteristics, or with the use of other methods, components, materials, and so forth. Therefore, although a particular detail of an embodiment of the invention may not be necessarily shown in each and every drawing describing such embodiment, the presence of this particular detail in the drawing may be implied unless the context of the description requires otherwise. In other instances, well known structures, details, materials, or operations may be not shown in a given drawing or described in detail to avoid obscuring aspects of an embodiment of the invention that are being discussed. Furthermore, the described single features, structures, or characteristics of the invention may be combined in any suitable manner in one or more further embodiments.

For the purposes of this disclosure and the appended claims, the use of the terms "substantially", "approximately", "about" and similar terms in reference to a descriptor of a value, element, property or characteristic at hand is intended to emphasize that the value, element, property, or characteristic referred to, while not necessarily being exactly as stated, would nevertheless be considered, for practical purposes, as stated by a person of skill in the art. These terms, as applied to a specified characteristic or quality descriptor means "mostly", "mainly", "considerably", "by and large", "essentially", "to great or significant extent", "largely but not necessarily wholly the same" such as to reasonably denote language of approximation and describe the specified characteristic or descriptor so that its scope would be understood by a person of ordinary skill in the art. The use of this term in describing a chosen characteristic or concept neither implies nor provides any basis for indefiniteness and for adding a numerical limitation to the specified characteristic or descriptor. As understood by a skilled artisan, the practical deviation of the exact value or characteristic of such value, element, or property from that stated may vary within a range defined by an experimental measurement error that is typical when using a measurement method accepted in the art for such purposes. As an example only, a reference to a vector or line or plane being substantially parallel to a reference line or plane is to be construed as such vector or line extending along a direction or axis that is the same as or very close to that of the reference line or plane (with angular deviations from the reference direction or axis that are considered to be practically typical in the art, for example between zero and fifteen degrees, more preferably between zero and ten degrees, even more preferably between zero and 5 degrees, and most preferably between zero and 2 degrees). A term "substantially flexible", when used in reference to a housing or structural element providing mechanical support for a contraption in question, generally identifies the structural element the flexibility of which is higher than that of the contraption that such structural element is associated with. As another example, the use of the term "substantially flat" in reference to the specified surface implies that such surface may possess a degree of non-flatness and/or roughness that is sized and expressed as commonly understood by a skilled artisan in the specific situation at hand. For example, the terms "approximately" and about", when used in reference to a numerical value, represent a range of plus or minus 20% with respect to the specified value, more preferably plus or minus 10%, even more preferably plus or minus 5%, most preferably plus or minus 2%.

The invention as recited in claims appended to this disclosure is intended to be assessed in light of the disclosure as a whole, including features disclosed in prior art to which reference is made.

The invention claimed is:

1. A holder for a card, the holder comprising:

a body including:

a top portion with an upper outer surface, a bottom portion with a lower outer surface, two side walls connecting the top portion with the bottom portion, each of the two side walls having a height, an actuator platform that is supported by and extends substantially parallel to the lower outer surface between the two side walls and that is separated from the bottom portion by a first distance that is shorter than the height, wherein a lower surface of the actuator platform, an upper internal surface of the bottom portion, and inner surfaces of the two side walls define an interior cavity with a front opening at a front end of the body and at least one back opening at a back end of the body, at least one actuator configured to slidably and reversibly move toward the front opening of the case above an upper surface of the actuator platform, the at least one actuator including a J-shaped member having a first end configured to engage at least one card when said at least one card is housed within the interior cavity and reposition said at least one card in a direction towards the front opening, and a back cover dimensioned to be removably cooperated with the body by sliding a top of the back cover between the two side walls to close the at least one back opening at the back end of the body from view.

2. A holder according to claim 1, (2A) wherein the at least one actuator includes a plurality of actuators and the holder is configured as a holder for the plurality of cards each of which is dimensioned as a wallet-sized card, and/or (2B) wherein the two side walls connect the upper outer surface with the lower outer surface spatially uninterruptingly, and/or (2C) wherein said body is a monolithic body, and/or (2D) wherein the body further comprises a slot formed in at least one of the two side walls in a direction substantially transverse to the top portion and/or the bottom portion, and wherein the holder additionally includes a corresponding resilient clutch pad dimensioned to be removably inserted into and through said slot transversely to the at least one of the two side walls to frictionally engage the plurality of cards within the internal cavity.

3. A holder according to claim 1, (3A) wherein inner surfaces of the two side walls contain corresponding parallel grooves extending in said direction towards the front opening along the two side walls and spatially aligned with the at least one actuator of the plurality of actuators, and/or (3B) wherein the first end of said J-shaped member of the at least one actuator is configured to engage the at least one card when said at least one card is housed in said parallel grooves, and/or (3C) wherein a side of said J-shaped member connecting the first end of the J-shaped member with a second end thereof carries a surface relief thereon, and/or (3D) wherein said J-shaped member carries an indicium representing contents of the corresponding parallel slots.

4. A holder according to claim 1, wherein an upper surface of the actuator platform extends under the upper outer surface of the top portion thereby forming a slot-like pocket between the actuator platform and the upper outer surface.

5. A holder according to claim 4, wherein said slot-like pocket is dimensioned to receive therein a second end of the J-shaped member.

6. A holder according to claim 1, wherein the upper surface of the actuator platform contains at least one groove that extends along the direction and that is shorter than an extent of the actuator platform along the direction, and/or wherein the upper surface of the actuator platform contains a plurality of substantially parallel grooves each of which is shorter than said extent.

7. A holder according to claim 1, wherein, when the upper surface of the actuator platform contains at least one platform groove extending along the direction, the at least one actuator includes a corresponding actuator groove that faces said at least one platform groove when the corresponding actuator is assembled with the body.

8. A holder according to claim 7, further comprising at least one compression spring dimensioned to be housed in an elongated space formed between the at least platform groove and the corresponding actuator groove when the corresponding actuator is assembled with the body.

9. A holder according to claim 6, wherein the at least one actuator includes a protrusion extending from a base of the J-shaped member towards a second end of the J-shaped member.

10. A holder according to claim 9, wherein the protrusion is configured as a substantially cylindrical element extending substantially parallel to said actuator groove.

11. A holder according to claim 1, (11A) wherein the at least one actuator includes a plurality of actuators, wherein each actuator of the plurality of actuators is configured to slidably and reversibly move toward said opening of the case above the upper surface of the actuator platform, wherein each actuator of the plurality of actuators includes a corresponding J-shaped member, and different J-shaped members of different actuators of the plurality of actuators have different dimensions, and/or (11B) wherein the back cover is dimensioned to be removably attached to the body by sliding the top of the back cover between the two side walls to sandwich a portion of the at least one actuator, which has been engaged with the body, between the back cover and the back end of the body.

12. A holder according to claim 1, wherein:

(12A) wherein the body further comprises one or more support stops configured to connect the actuator platform to the bottom portion of the body such as to define said at least one back opening at a back end of the body, and wherein at least one of said one or more support stops includes a groove in a surface thereof facing the volume of the interior cavity;

and/or (12B) wherein, when there are more than one of said one or more support stops, at least one of said support stops includes said groove while another of said one or more support stops is devoid of such groove.

13. A method comprising:

using the holder according to claim 1, the holder containing at least one card placed in the interior cavity with an edge of the at least one card against the first end of the J-shaped member of the at least one actuator:

moving a portion of the J-shaped member located above the actuator platform from a rest location in the direction towards the front opening to reposition a second end of the J-shaped member within a slot-like pocket formed between the actuator platform and the upper outer surface.

14. A method according to claim 13, further comprising:

while so moving, repositioning the at least one card below the actuator platform towards the front opening by pushing the edge with the first end of the J-shaped member.

15. A method according to claim 13, wherein said moving includes compressing a spring positioned in contact with the J-shaped member, and further comprising:

after a portion of the at least one card emerges through the front opening as a result of said repositioning, returning the portion of the J-shaped member to the rest location by releasing the spring.

16. A method according to claim 15, wherein said returning includes maintaining the second end of the J-shaped member within the slot-like pocket and/or disengaging the first end from the edge surface of the at least one card.

17. A method according to claim 13, wherein said moving includes sliding a protrusion of the J-shaped member, which extends under said portion of the J-shaped member, along and/or in a groove in the actuator platform.

18. A method according to claim 14, wherein said pushing includes displacing the first end of the J-shaped member between a side wall of the two side walls and a support stop connecting the actuator platform with the bottom portion of the body.

19. A method comprising:

operating a card holder that has a body defining an inner cavity therein and having a front opening at a front end of the holder, wherein the inner cavity is limited by an upper plate, a lower plate, and two side walls, and wherein the upper plate is structured to bifurcate away from the front opening into a first subplate and a second subplate forming a gap therebetween by at least:

slidably reversibly moving at least one actuator that includes a J-shaped member having a long arm positioned above the second subplate and a short arm positioned below the second subplate towards the front opening such as to reposition an end of the long arm within the gap.

20. A method according to claim 19, wherein said operating includes removing an edge of a card, disposed within the inner cavity, from a groove formed in a support stop connecting the second subplate with the lower plate.

21. A holder for a plurality of cards, the holder comprising:

a body defining an inner cavity that has a front opening at a front end of the holder and at least one back opening at a back end thereof, the inner cavity being limited by an upper plate, a lower plate, and two side walls, wherein the upper plate bifurcates towards the at least one back opening into a first subplate and a second subplate extending towards the back opening farther than the first subplate, the first and second subplates separated from one another along the two side walls by a gap.

* * * * *